US006516643B1

(12) United States Patent
Olshausen

(10) Patent No.: US 6,516,643 B1
(45) Date of Patent: Feb. 11, 2003

(54) POP-UP, PRECISION LOCK-CYLINDER THAT REVEALS AT ONCE, WITH VISUAL AND TACTILE CUES, WHO ELSE WITH A KEY HAS SOUGHT OR GAINED ENTRY

(76) Inventor: Michael Cohnitz Olshausen, P.O. Box 2075, Bristol, PA (US) 19007

( * ) Notice: Subject to any disclaimer, the term of this patent is extended or adjusted under 35 U.S.C. 154(b) by 272 days.

(21) Appl. No.: 09/590,694

(22) Filed: Jun. 9, 2000

(51) Int. Cl.[7] ..... E05B 35/08

(52) U.S. Cl. ..... 70/337; 70/432; 70/340; 70/367; 70/441

(58) Field of Search ..... 70/337–343, 432, 70/438, 441, 379 R, 367, 369–371

(56) References Cited

U.S. PATENT DOCUMENTS

| | | | | | |
|---|---|---|---|---|---|
| 1,968,555 | A | * | 7/1934 | Horne | 70/367 X |
| 2,113,007 | A | | 4/1938 | Swanson | 70/382 |
| 3,503,642 | A | | 3/1970 | Poe | 292/101 |
| 3,824,819 | A | | 7/1974 | Neary | 70/432 |
| 5,269,162 | A | | 12/1993 | Robida et al. | 70/379 R X |
| 5,289,705 | A | | 3/1994 | Grimmer | 70/441 X |
| 5,491,993 | A | * | 2/1996 | Anderson | 70/367 |
| 6,047,577 | A | | 4/2000 | Klimas | 70/340 |

* cited by examiner

*Primary Examiner*—Suzanne Dino Barrett

(57) ABSTRACT

Pop-Up Indicator, Replacement Lock-Cylinder with distinctive keys for owner, employee (or acquaintance), and some third party whose right to enter is legitimate only upon notice or in an emergency. The pop-up indicators are brightly and differently colored. The lock cannot be circumvented by pressing a pop-up in and endeavoring to turn the key, because the pop-up's barrel blocks rotation of the lock's core unless the pop-up is fully extended. Once triggered, the pop-up remains visible and in locked position until the lock owner resets it. A tactile indicator of sought entry is transmitted to the owner upon key insertion and rotation, as well. Meanwhile, the employee and/or third party enjoys unimpeded access. The owner will thus know whether the employee has been over—to inspect for termites, walk the dog, etc.—and the third party cannot allege lockout lease breaking. The lock operates quite normally with either or both pop-ups triggered. Since only the employee's key or the third-party key (but not the owner's key) is capable of triggering a pop-up, if these keys have been given out, the owner obtains prima facie proof of sought entry. The owner may wish to leave a pop-up exposed in order to show a witness or possibly the police.

60 Claims, 17 Drawing Sheets

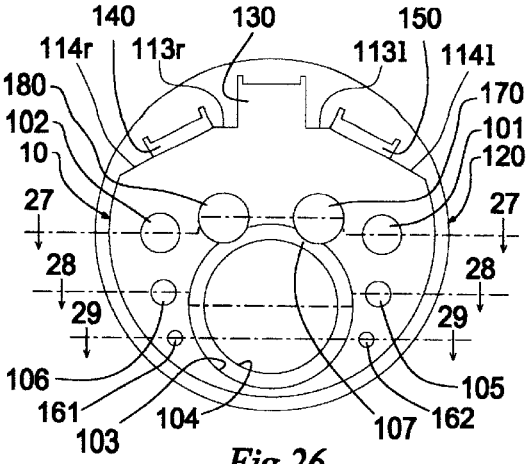
Fig.26
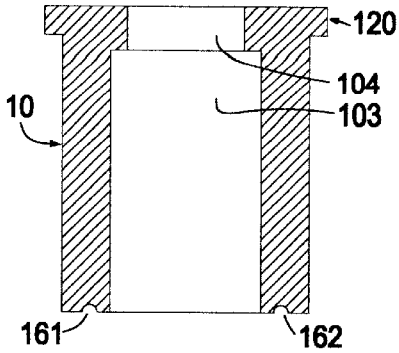
Fig.29
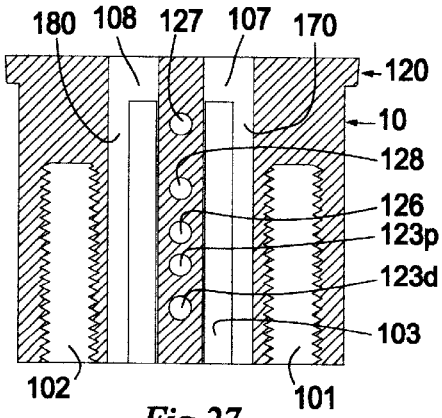
Fig.27
Fig.30
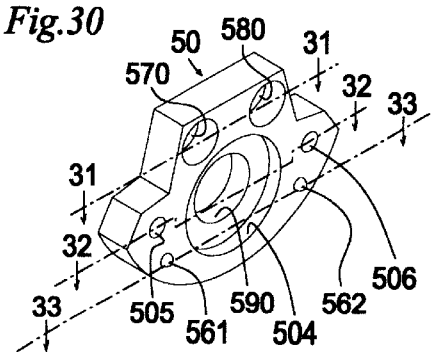
Fig.31
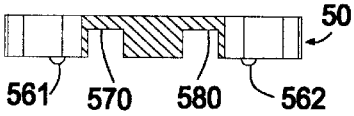
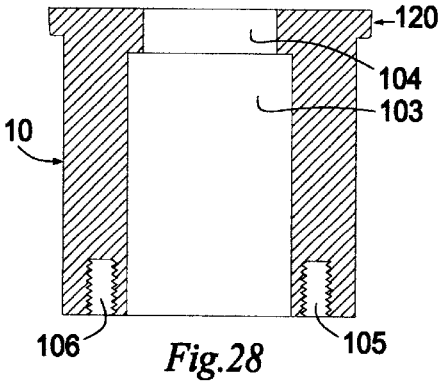
Fig.28
Fig.32
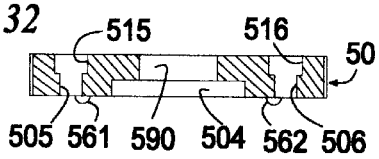
Fig.33
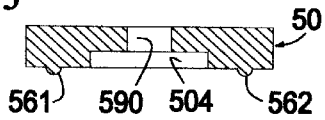

Key Function vs. Key

| | A-Key | B-Key | M-Key |
|---|---|---|---|
| has assigned pop-up | | x | x |
| can trigger B pop-up | | x | |
| can trigger M pop-up | | | x |
| can reset B pop-up | x | | |
| can reset M pop-up | x | | |
| reset of B pop-up is optional | x | | |
| reset of M pop-up is optional | x | | |
| can enter with B pop-up out | x | x | x |
| can enter with B pop-up in | x | | x |
| can enter with M pop-up out | x | x | x |
| can enter with M pop-up in | x | x | |
| can renter with B pop-up out | x | x | x |
| can renter with M pop-up out | x | x | x |
| tactile cue of sought entry | x | | |

*Fig.46*

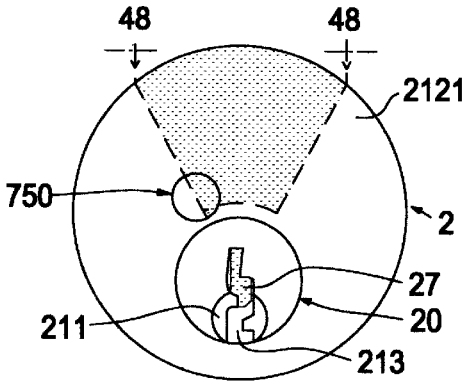
Fig.47
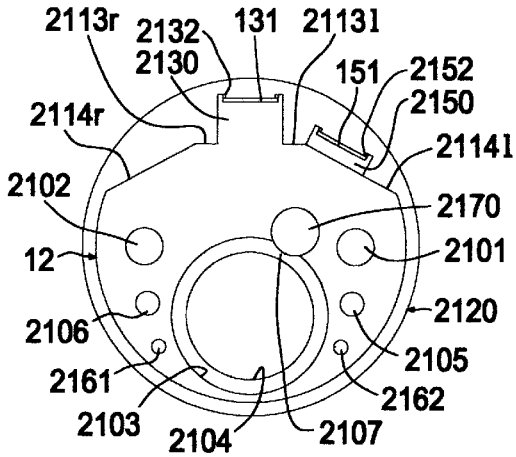
Fig.49
Fig.48
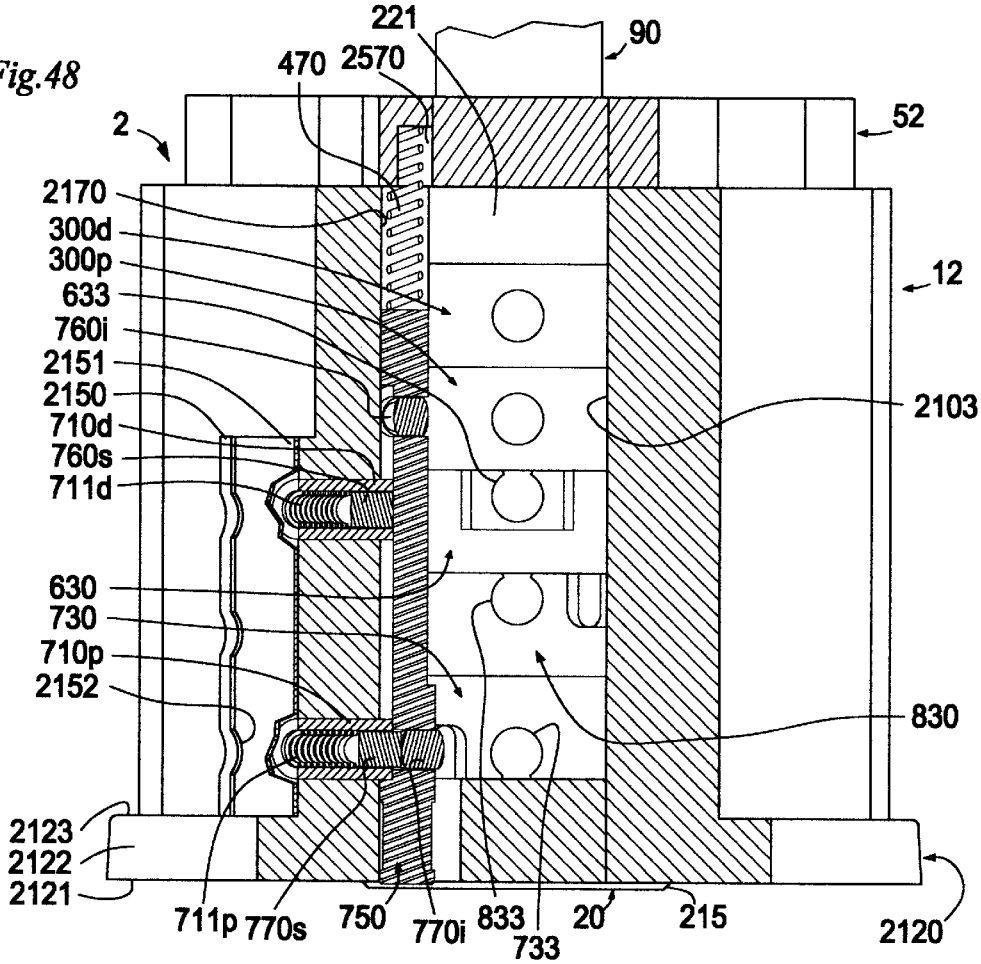

POP-UP, PRECISION LOCK-CYLINDER THAT REVEALS AT ONCE, WITH VISUAL AND TACTILE CUES, WHO ELSE WITH A KEY HAS SOUGHT OR GAINED ENTRY

CROSS-REFERENCE TO RELATED APPLICATIONS

Not Applicable

STATEMENT REGARDING FEDERALLY SPONSORED RESEARCH OR DEVELOPMENT

Not Applicable

PREFERENCE TO A MICROFICHE APPENDIX

Not Applicable

BACKGROUND OF THE INVENTION

Indicator locks, particularly having non-numeric indicators, broadly define the art wherein the present invention resides. Lock engagement—has the latch and/or dead bolt been thrown?—or else room occupancy—did somebody now inside this room lock this lock?—are commonly indicated conditions. Left unaddressed by the prior art of which applicant is aware is a different, and essentially evidentiary, question. Given the desirability of permitting a known party to enter a lock-protected space ad hoc or on schedule (a landlord in an emergency, a house sitter to feed cats, etc.), how should a lock best indicate that such an event has occurred, while preserving its operability for all of the parties having keys, meanwhile providing the lock owner with the option of presenting evidence of, and/or of confronting with evidence of, entry improperly sought or gained, or of a trust neglected?

Cylindrical elements that are geared or journaled to rise up or are pushed by a spring-loaded lever into full extension are well-known as indicator devices. Parts for lock mechanisms, including such button-form indicators, generally are made from cast metal and/or from sintered, powdered metal, and springs of all sorts find lock-mechanism application. For short, cylindrical parts a half-inch in diameter, tolerances of ±0.3% or better are economically and routinely achieved using powdered-metal injection molding. Tight tolerances make possible functional refinement.

The principal objective of the present invention is to answer, then, by means of an exemplary, high-precision lock producible with advanced but available technology, the evidentiary question articulated above.

SURVEY OF BACKGROUND ART

U.S. Pat. No. 1,177,151 to Teich (1916) discloses a lock indicating mechanism having a button-type indicator driven by a spring always into the lock (p. 3, lines 82–84), not outwardly as in the present invention. Teich's indicator furthermore requires the movement of a bolt, this movement having the effect of deadlocking the door to which the lock is applied, for the shank of Teich's indicator to become visible. In the present invention, merely the slight rotation of a key in the lock, occurring well before any bolt is thrown, is all that is required for that key's associated indicator to pop out. Teich's motivation, described on p. 3, lines 101–116, is to prevent an occupied room from being disturbed. The present invention's motivation is broader and has to do with trust not being misplaced or abused.

U.S. Pat. Nos. 1,154,142 and 1,177,152 to Teich (1915, 1916) disclose three classes of keys. These keys, however, are hierarchical, in that the operation of Teich's lock by at least one of the keys excludes operation of the lock by the remaining key or keys (U.S. Pat. No. 1,154,142 p. 1, lines 18–21; and 1,177,152 p. 1, lines 16–19). In the present invention all of the keys are equal with respect to operation of the lock qua lock. No key excludes any other key.

U.S. Pat. No. 2,638,770 to Gutman (1953) discloses a lock-indicating mechanism having a button-type indicator driven by a spring into the lock (FIG. 7 & col. 3, lines 71 to col. 4, in 1), not outwardly as in the present invention. Gutman's indicator is furthermore designed to indicate whether a dead bolt has been thrown from inside or from outside a room, and is operable exclusively by the retractors that operate the lock's dead bolt. Both the mechanism as well as motivation of Gutman's indicator are entirely different from the present invention's.

U.S. Pat. No. 3,336,775 to Russell et al. (1967) shows a button-type indicator driven by a spring into the lock (FIG. 5 & col. 3, lines 34–38). Furthermore, "the position of the indicator member is directly related to the position of [the lock's] dead bolt" [col. 4, lines 37–38]. The mechanism and motivation of this indicator lock are entirely different from the present invention's.

U.S. Pat. No. 526,740 to Rapaport (1894) appears at first glance to have an indicator means, "dog 28", that is urged out of Rapaport's combination lock. On reading, however, we discover that "dog 28" is not an indicator means at all but is rather a counting means (page 2, lines 77–80). In fact, "dog 28" indicates nothing whatever about the present condition of Rapaport's lock nor about its use by parties with knowledge of its combination.

U.S. Pat 2,793,522 to Tornoe (1957) discloses a geared indicator able to show only whether the lock is locked or not. The mechanism and motivation of Tornoe's lock differ entirely from the present invention's. Interesting in Tornoe is FIG. 2, because this figure is what a linguist might term a near homograph of the present invention. What the unnumbered circle to the right of tumbler 18 in Tornoe's FIG. 2 might be, Tornoe never says, even though this detail appears again in mirror image in FIGS. 3 and 4, and appears slightly extended in FIG. 5 (n.b. 37 refers to the lock face). Homographs like homonyms, however, have totally different meanings.

U.S. Pat. No. 3,885,409 to Genakis (1975) shows a cylinder lock having "a set of independently rotational rings on the plug, one ring for each pinway" [col 2, lines 48–50]. Genakis then adds further rings, but is motivated exclusively by two desires: to increase the number of lock combinations and to make the lock more difficult to pick. Genakis gives no shape to his rings that might enable them to serve in additional, functional capacities.

BRIEF SUMMARY OF THE INVENTION

The present invention confines cylindrical indicators, the "pop-ups", in cylindrical bores parallel to and close to the lock's rotatable core. The pop-ups are urged forward from behind by springs but are prevented from movement by pins which drop into bores orthogonal to the pop-up's length. The pop-ups are now armed. Ring-like elements are mounted over the lock-core that are so formed as to be able, on rotation with the core by a key, to lift these obstructing pins and thus to release the po-pup to pop up. Stops prevent the pop-ups from shooting out of the lock. In the instant before a stop is encountered, a pin falls from above into a bore in the pop-up placed orthogonal to its direction of motion, thus locking the pop-up, so that it cannot be pressed back in. A different key, which cannot trigger a po-pup, has the ability, via a different, core-mounted ring, to lift this locking pin, so that the pop-up may be reset. In the preferred embodiment, two independent pop-ups are provided. The pop-ups' armed positions may be symbolically indicated in a variety of ways, as for example by the letters A and B (alternatively by such non-lingual symbols as □ and ○), with the pop-ups' respective "popped-out", or indicator, positions being indicated symbolically by AA and BB (alternatively by ■ and ●) Having two pop-ups entails locating the lock's tumblers asymmetrically in the plane containing their axes. This is unusual and enhances considerably the security of the lock against anyone not thoroughly familiar with its construction and not equipped with the necessary, proprietary lock picks.

The present invention has several important objects, among which are:

1) security against unannounced entry by persons having contractually-guaranteed access to a key
2) security against an intruder who has somehow gained access to a key
3) security against curiosity snooping
4) enhanced ability to monitor the performance of an employee
5) enhanced security through keys having asymmetrically placed keycuts
6) enhanced security through keys having independent, dummy keycuts These and still-further objects and advantages of the present invention will become apparent from a consideration of the following detailed specification, drawings, and appended claims.

BRIEF DESCRIPTION OF THE SEVERAL VIEWS OF THE DRAWING

Referring to the drawings, wherein like reference characters indicate like parts or elements throughout the several views, and wherein arrowheads indicate physically-composite objects whose resolution into numbered, constituent parts occurs when germane to the discussion:

FIG. 26 is a rear plan view of the largest single element of the embodiment of FIG. 1.

FIG. 27 is a cross-sectional view of the element of FIG. 26 taken along broken, rectilinear line 27—27 of FIG. 26.

FIG. 28 is a cross-sectional view of the element of FIG. 26 taken along broken, rectilinear line 28—28 of FIG. 26.

FIG. 29 is a cross-sectional view of the element of FIG. 26 taken along line 29—29 of FIG. 26.

FIG. 30 is a front isometric view of the plate seen attached to the rear, or distal, end of the preferred embodiment in FIG. 2.

FIG. 31 is a cross-sectional view of the plate of FIG. 30 taken along line 31—31 of FIG. 30.

FIG. 32 is a cross-sectional view of the plate of FIG. 30 taken along broken., rectilinear line 32—32 of FIG. 30.

FIG. 33 is a cross-sectional view of the plate of FIG. 30 taken along line 33—33 of FIG. 30.

FIG. 46 is a table.

FIG. 47 is a front plan view of an alternate embodiment of the present invention having just one indicator element.

FIG. 48 is a top, plan, partial cutaway view of the alternate embodiment introduced in FIG. 47 taken along line 48—48 of FIG. 47 and with the portions shaded in FIG. 47 removed and with an element partially broken away.

FIG. 49 is a rear plan view of the alternate embodiment shown in FIGS. 47 and 48 but the rear plate thereto removed and emptied of moving parts.

DETAILED DESCRIPTION OF THE INVENTION

Figure 1:
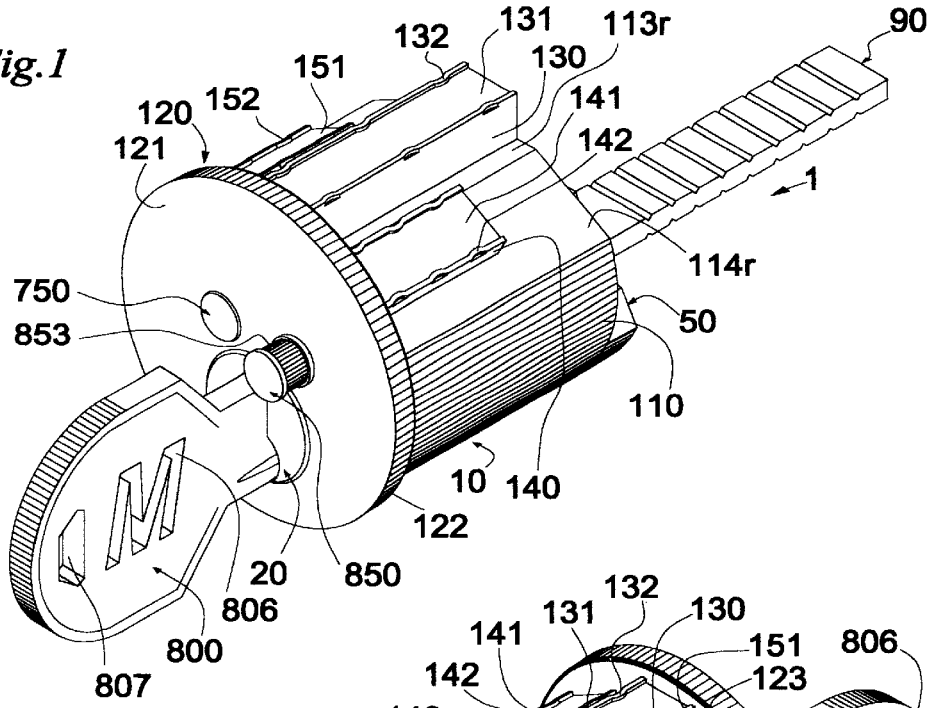
FIG. 1 is a front, isometric drawing of the present invention's preferred embodiment.
Figure 2:
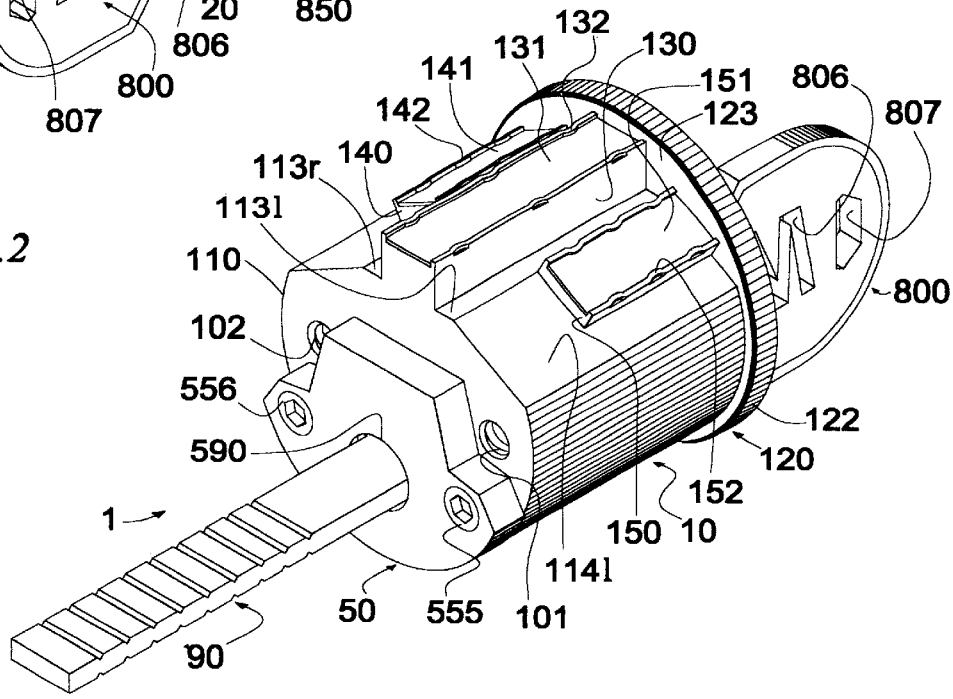
FIG. 2 is a rear, isometric drawing of the embodiment in FIG. 1.

FIGS. 1 and 2 show lock 1 having body 10, flange 120, rear plate 50, tail-piece 90, and M-key 800. Body 10 comprises barrel element 110, flat facets 113*r* and 113*l* abutting tumbler head 130, and flat facets 114*r* and 114*l* carrying, respectively, pop-up heads 140 and 150. Flange 120 has proximal face 121, rim 122, and distal face 123. Body 10 and flange 120 are integrally formed from metal, as by molding. (Throughout the specification and claims, r=right and l=left, p=proximal and d=distal, always with respect to a lock-user looking square at face 121)

Tumbler head 130 carries hold-down strip 131 held in place by six tabs 132, which are forcibly crimped to overlap and press down upon strip 131, in the usual manner. Pop-up head 140 carries hold-down strip 141 retained by six, crimped tabs 142, and pop-up head 150 carries hold-down strip 151 retained by six, crimped tabs 152.

Able to turn within body 10 is core 20, into which M-key 800 is shown inserted. Above and to the left and right of core 20 are indicator means 750 and 850, called pop-ups after their method of functioning. Pop-up 750 is armed and thus extends only very slightly beyond face 121, about 0.5% of its overall length, whereas pop-up 850 has been triggered by a slight rotation of M-key 800 (preview FIGS. 34–41) and, thus, is fully extended, about 16% of its overall length. The difference in extension is quite noticeable. Band 853 emphasizes the condition of pop-up 850 and here is shown to be red. M-key 800 has identifying aperture 806, here the letter M for Management, and key-chain aperture 807.

Seen best in FIG. 2 is rear plate 50 attached to body 10, i.e. to the distal end of lock 1, by hex-head allen cap-screws 555 and 556. Plate 50 has bore 590 through which tail-piece 90 extends. Body 10 has threaded holes 101 and 102 by means of which lock 1 may be coupled to an otherwise garden-variety lock mechanism using the standard break-off screws.

Figure 3:
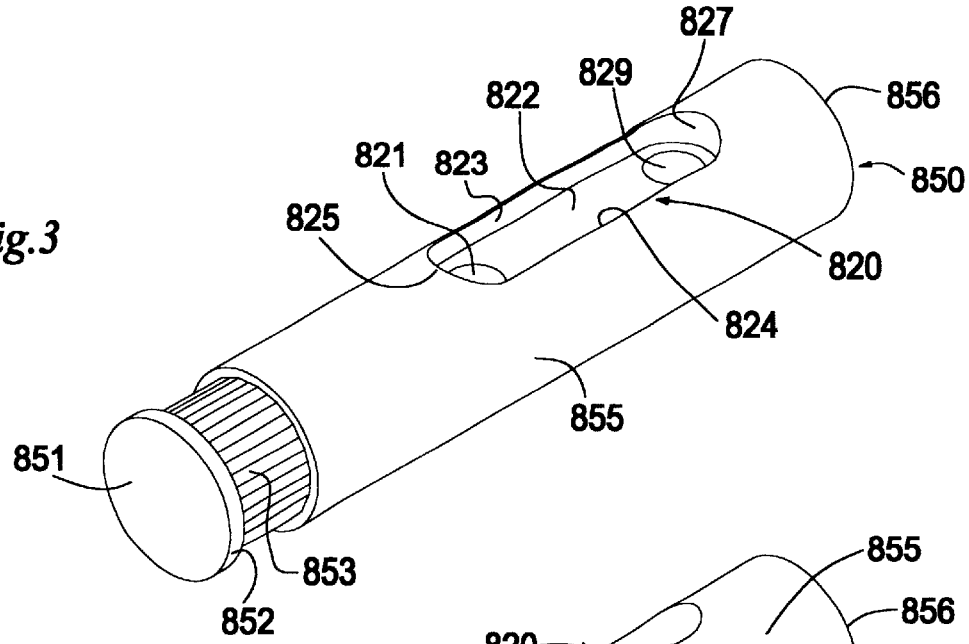
FIG. 3 is a front isometric view of the right indicator-element introduced in FIG. 1.

FIG. 3 shows pop-up 850, associated with M-key 800. Pop-up 850, substantially a long cylinder with a corresponding length-wise axis, has body 855 in which features are defined by the elimination or absence of material. Proximal face 851 has rim 852, behind which is colored barrel 853, here red. Barrel 853 is slightly less in diameter than body 855, so that a plastic band or a thin paint layer, whatever colors it, will not be abraded when the pop-up moves. The colored portion of pop-up 850, whether barrel-shaped as here or shaped otherwise, needs merely to be recessed from the surface of pop-up 850. Trough 820 extends lengthwise and parallel to pop-up 850's lengthwise axis, and has flat bottom 822, left side wall 823, right side wall 824, proximal cylindrical wall 825, and distal cylindrical wall 827. At the proximal end of trough 820 is bore 821, which extends through body 855 perpendicular to flat bottom 822. At the distal end of trough 820 is bore 829, which extends through body 855 perpendicular to face 822. Pop-up 850 has flat rear face 856.

Figure 4:
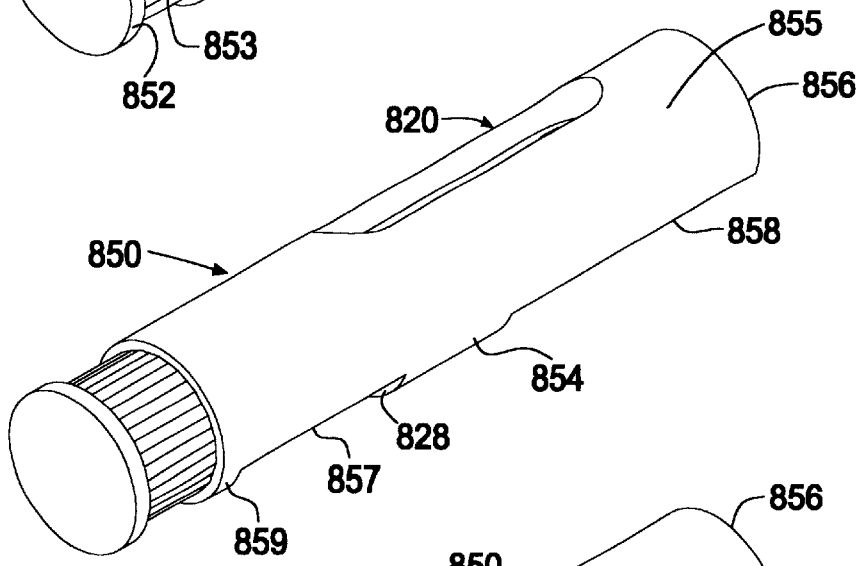
FIG. 4 is the indicator-element shown in FIG. 3 rotated 25° about it's long axis.

FIG. 4 shows pop-up 850 rotated 250 about its long axis. Coming into view are features seen best in FIG. 5.

Figure 5:
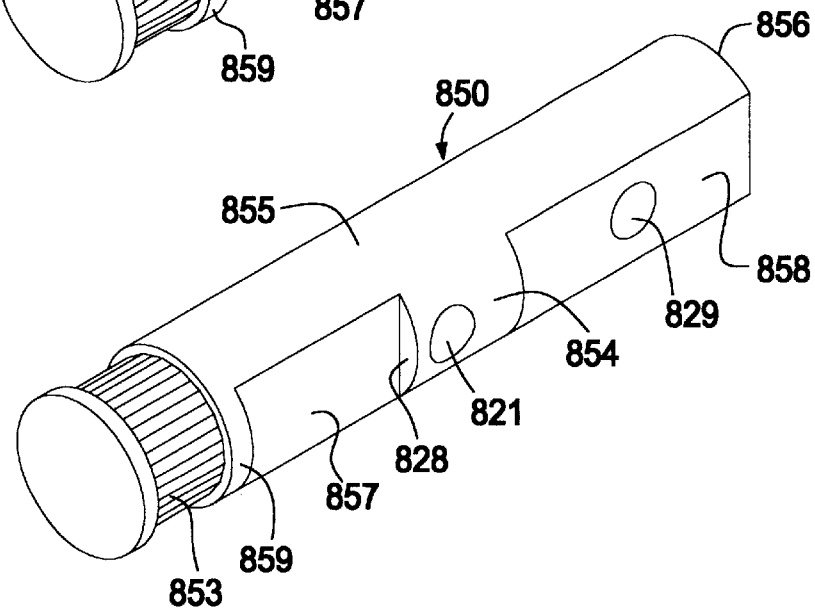
FIG. 5 is the indicator-element shown in FIG. 3 rotated 90° about it's long axis.

FIG. 5 shows pop-up 850 rotated 90° about its long axis, showing disjoint, coplanar under surfaces 857 and 858, both parallel to trough bottom 822. Surface 857 stops short of barrel 853, resulting in front cylindrical remainder 859. Surface 858 extends to the distal end of body 855, where it intersects rear face 856 perpendicularly. Bore 829 ends at surface 858. Between surfaces 857 and 858 is fully-cylindrical blocking portion 854 through which bore 821 extends. Blocking portion 854 has proximal, flat wall 828, perpendicular to surface 857.

Figure 6:
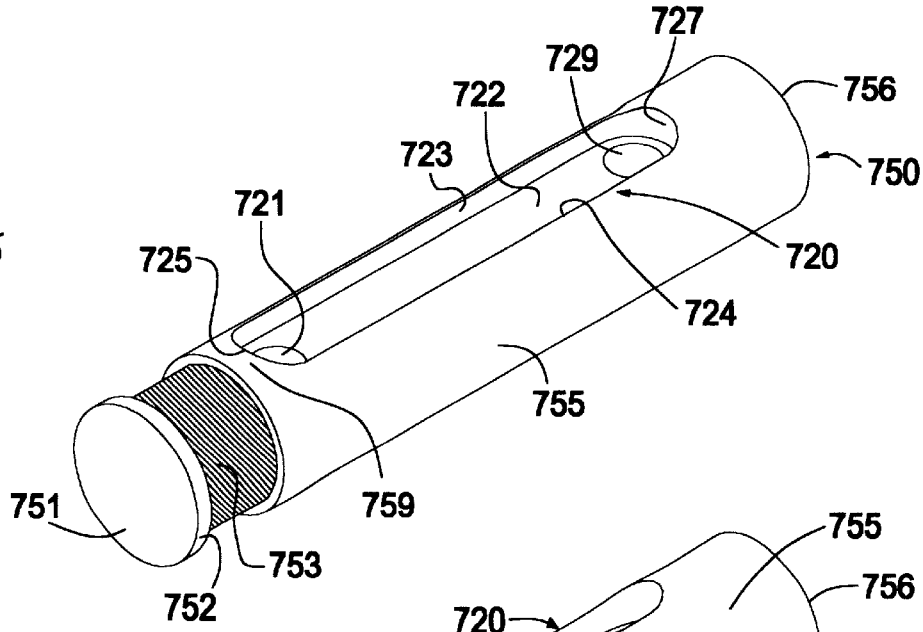
FIG. 6 is a front isometric view of the left indicator-element introduced in FIG. 1.

FIG. 6 shows pop-up 750, associated with B-key 700 (preview FIGS. 35–41). Pop-up 750, substantially a long cylinder with a corresponding lengthwise axis, has body 755 in which features are defined by the elimination or absence of material. Proximal face 751 has rim 752, behind which is barrel 753, here colored green. Barrel 753 is slightly less in diameter than body 755, so that a plastic band or a thin paint layer, whatever colors it, will not be abraded when the pop-up moves. The colored portion of pop-up 750, whether barrel-shaped as here or shaped otherwise, merely needs to be recessed from the surface of pop-up 750. Trough 720 extends lengthwise and parallel to pop-up 750's lengthwise axis and has flat bottom 722, left side wall 723, right side wall 724, proximal cylindrical wall 725, and distal cylindrical wall 727. Between wall 725 and barrel 753 is cylindrical remainder portion 759. At the proximal end of trough 720 is bore 721, which extends through body 755 perpendicular to flat bottom 722. At the distal end of trough 720 is bore 729, which extends through body 755 perpendicular to flat bottom 722. Pop-up 750 has flat rear face 756.

Figure 7:
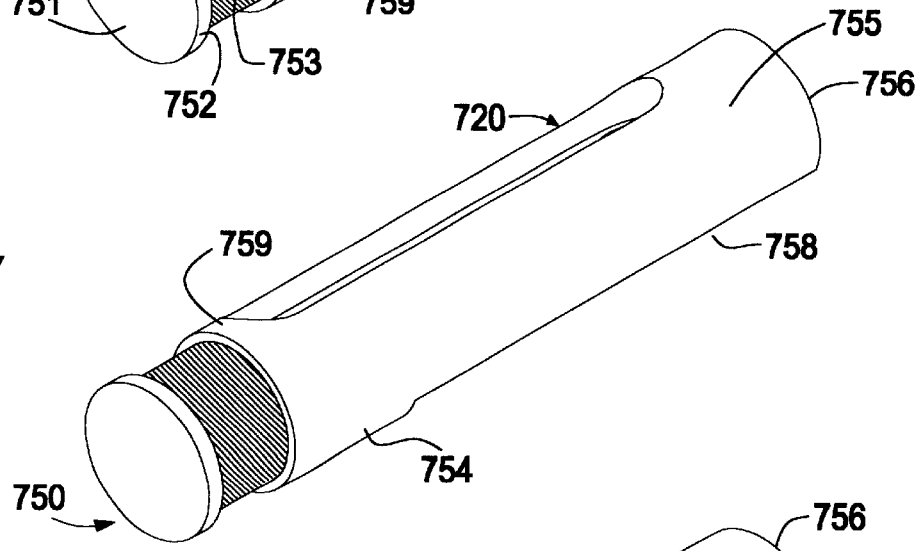
FIG. 7 is the indicator-element shown in FIG. 6 rotated 25° about it's long axis.

FIG. 7 shows pop-up 750 rotated 25° about its long axis. Coming into view are features seen best in FIG. 8.

Figure 8:
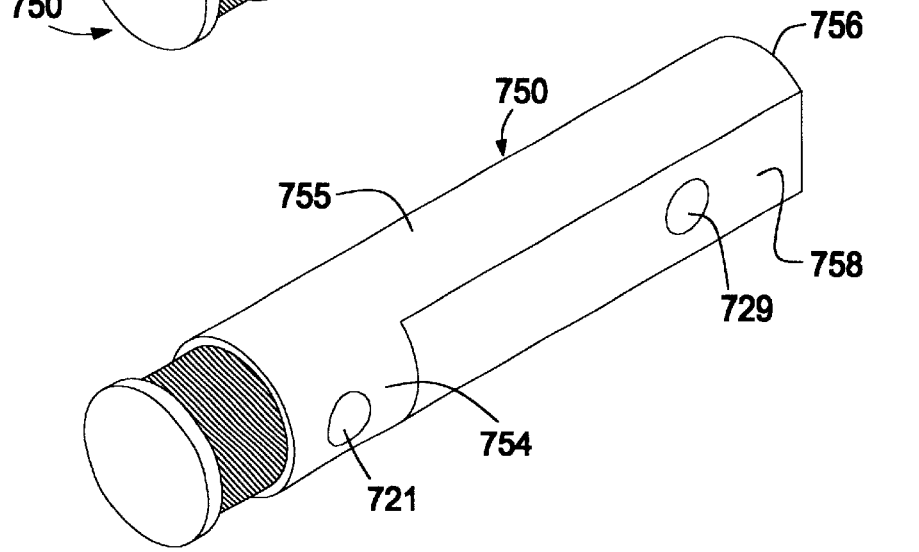
FIG. 8 is the indicator-element shown in FIG. 6 rotated 90° about it's long axis.

FIG. 8 shows pop-up 750 rotated 90° about its long axis, and showing flat under surface 758, parallel to trough bottom 722. Surface 758 stops short of barrel 753, so that fully-cylindrical blocking portion 754 is left, through which bore 721 extends. Surface 758 extends to the distal end of body 755, where it intersects rear face 756 perpendicularly.

Bore 729 ends at surface 758. The lengthwise axis of pop-up 750 may be indicated symbolically in a variety of ways, as for example by X1. The lengthwise axis of pop-up 850 could then by analogy be indicated by X2.

Figure 9:
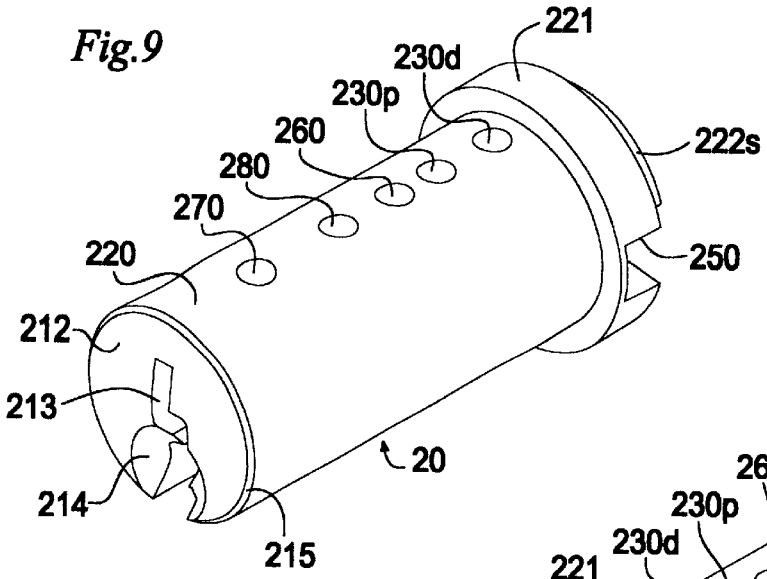
FIG. 9 is a front isometric view of the core of the embodiment introduced in FIG. 1.

FIG. 9 shows lock core 20 removed from lock 1. Core 20 has cylindrical, core body 220, and coaxial, cylindrical stop ring 221. Stop ring 221 has a larger diameter than core body 220 and is integrally formed with core 20. Stop ring 221 is partly cut away by slot 250 by means of which core 20 admits and communicates with tail-piece 90. At the distal end of stop ring 221 and separated by slot 250 are cylindrical rear portion 2228 and 222*i* (preview FIG. 10), integrally formed with core 20, which continue core body 220 a short distance beyond stop ring 221, thus giving core 20 a single, lengthwise axis. Core 20 has proximal face 212, keyway 213, key-start cone 214, and end bevel 215. Core 20 further has five lock-tumbler bores, namely bores 270, 280, 260, 230*p* and 230*d*. Bore 270 is associated with employee's B-key 700, trigger means 730, and pop-up 750 (preview FIGS. 11 and 18). Bore 280 is associated with management's M-key 800, trigger means 830, and pop-up 850 (preview FIGS. 11 and 19). Bore 260 is associated with lock-owner's A-key 600 and with reset ring 630 (preview FIGS. 11 and 17). Bores 230*p* and 230*d* are associated with plain rings 300*p* and 300*d*, respectively.

Bores 270, 280, 260, 230*p* and 230*d* are arrayed asymmetrically along the length of core body 220. This will turn out to be both an unusual and useful asymmetry.

Figure 10:
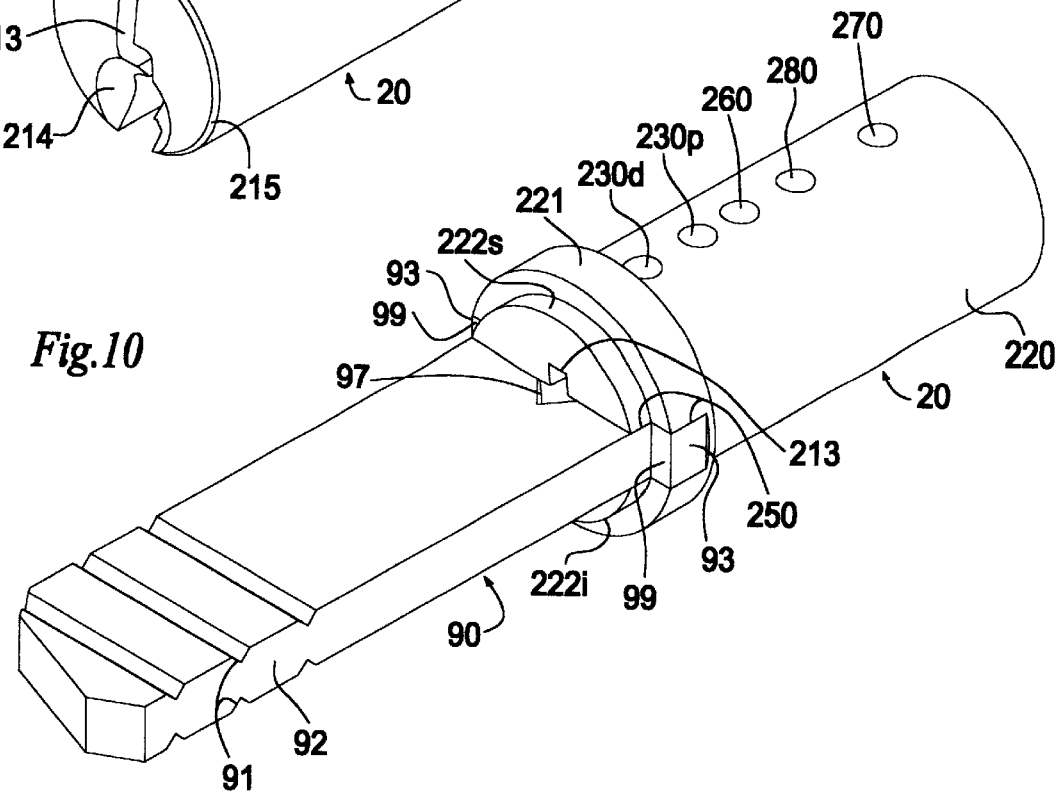
FIG. 10 is a rear isometric view of the core of the embodiment shown in FIG. 9 with a portion of the tail-piece

FIG. 10 shows core 20 from behind with tail-piece 90 inserted into slot 250. Tail-piece 90 has the usual notches 91 and break-off segments 92, by means of which its length may be adjusted to suit a particular application. Tail-piece 90 permits lock 1 to communicate with a larger locking mechanism, lock 1 ultimately becoming a component part thereof, thus permitting lock 1 to throw, for example, a dead bolt, generally by turning tail-piece 90 at least a quarter of a turn. The proximal end of tail-piece 90 is T-shaped, with symmetrical, extended wings 93 having symmetrical distal faces 99. This T-shaped end of tail piece 90 has v-shaped notch 97, a standard feature that allows keys to enter core 20 completely.

Figure 11:
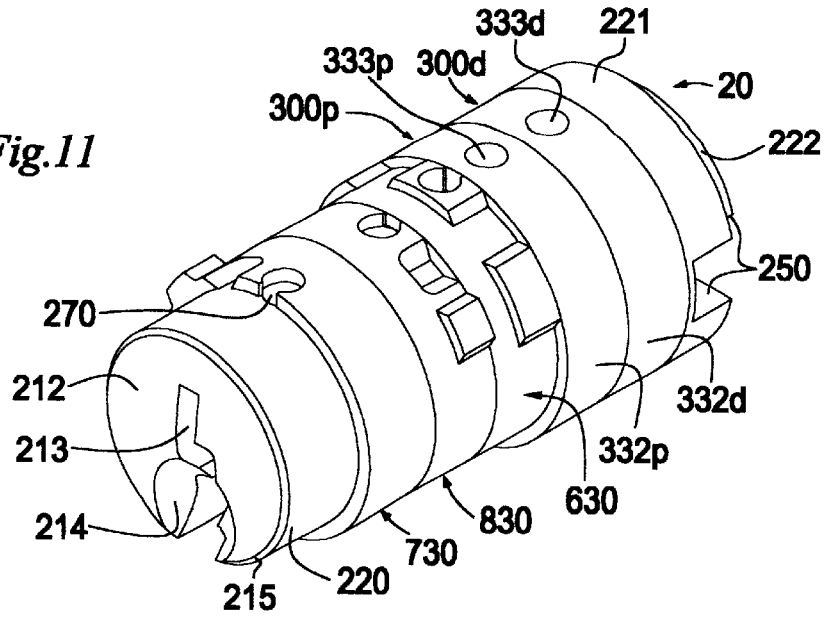
FIG. 11 is a front isometric view of the core shown in FIG. 9 with five, ring-like elements mounted thereupon.

FIG. 11 shows core 20 with trigger means 730, trigger means 830, reset means 630, and plain rings 300*p* and 300*d* mounted upon it. These ring-like or sleeve-like elements of lock 1 are substantially tubular in shape, albeit quite short in relation to their length, and have cylindrical inner surfaces all of the same diameter that bear lightly upon cylindrical core body 220. Their outermost surfaces are small, cylindrical segments the same in radius as the outer, cylindrical surface of stop ring 221. The shape of asymmetric trigger means 830 is congruent in detail to the shape of trigger means 730, however means 830 faces oppositely on core 20, that is, the like faces of means 730 and 830 lie adjacent to one another. The shapes of asymmetric trigger means 830 and 730 may be indicated symbolically in a variety of ways, as for example by T1 and T2, respectively. The shapes' congruency might then be expressed as T1≡T2, using conventional, geometric notation. Plain rings 300*p* and 300*d* have outer surfaces 332*p* and 332*d* and tumbler bores 333*p* and 333*d*, respectively.

Figure 12:
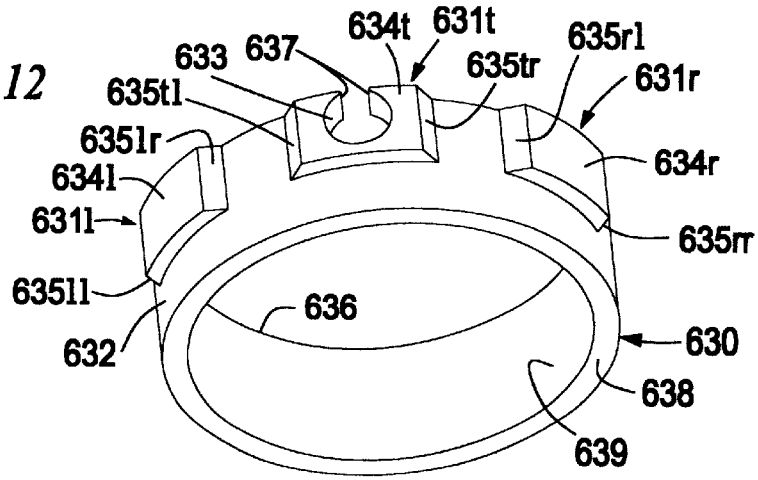
FIG. 12 is a top isometric view of the middle, ring-like element introduced in FIG. 11.

FIG. 12 shows pop-up reset means 630, which only the owner's A-key 600 can turn. Reset means 630 has inside surface 639, distal edge 636, proximal annular edge 638, and outside surface 632. Extending radially outward from surface 632 and integrally formed with it and, thus, with means 630 are left reset plateau 6311, right reset plateau 631*r* and tumbler plateau 631*t*. In the embodiment of the invention herein illustrated, these plateaus have the same width, which is somewhat greater than half the width of reset means 630. Left, tumbler, and right reset plateaus 6311, 631*t*, and 631*r* each have a left and right beveled face, numbered 63511 and 6351*r*, 635*tl* and 635*tr*, and 635*rl* and 635*rr*, respectively. Each plateau furthermore has a top face, numbered 6341, 634*t*, and 634*r*, respectively. Tumbler plateau 631*t* has tumbler bore 633, which extends perpendicularly through surface 634*t* and entirely through means 630. Bore 633 lies tangent to distal edge 636, which, apart from those portions of edge 636 contiguous with plateaus 631*l*, 631*t*, and 631*r*, is substantially annular in shape. To prevent sharp edges at the point of tangency, bore 633 is cut back slightly, resulting in chamfers 637.

Figure 13:
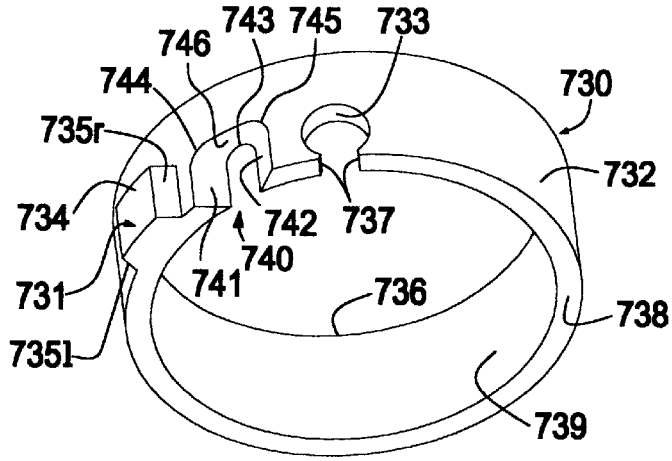
FIG. 13 is a top isometric view of the front, ring-like element introduced in FIG. 11.

FIG. 13 shows trigger means 730, which only the employee's B-key 700 can turn. Trigger means 730 has inside surface 739, proximal edge 738, distal annular edge 736, and outside surface 732. Extending from radially outward from surface 732 and integrally formed with means 730 is blocking plateau 731, having left and right beveled faces 7351 and 735*r*, and top face 734. In the embodiment of the invention herein illustrated, plateau 731 is one half the width of means 730. Means 730 further has tumbler bore 733, which extends perpendicularly through surface 732 and entirely through means 730. Bore 733 lies tangent to proximal edge 738, which, apart from those portions of edge 738 contiguous with plateau 731, is substantially annular in shape. To prevent sharp edges at the point of tangency, bore 733 is cut back slightly, resulting in chamfers 737.

Means 730 furthermore has trigger 740, which is a substantially wedge-shaped cutout entirely through means 730 and which extends from proximal edge 738 to trigger face 746, trigger face 746 lying very slightly, a few thousandths of an inch in practice, beyond the mid-circumference of cylindrical outer surface 732, i.e. a bit closer to edge 736 than to edge 738, in order to accommodate upper pin 25 without binding (preview FIGS. 17 and 38–41). Pin 25 will enter trigger 740 in cases where core 20 undertakes a complete revolution. Trigger 740 has left beveled face 741 and right beveled face 742. The intersections of bevels 741 and 742 with face 746 are filleted three-dimensionally, 117 resulting in top rounded corners 744 and 745, respectively, and in bottom rounded end 743. These roundings prevent stress from concentrating. Beveled faces 741 and 742 do not meet, but are spaced apart, so that trigger 740 has a U-shaped bottom aperture lying just adjacent to core body 220.

Trigger means 830, which only management's B-key 800 can turn is identical to means 700. References in the specification having an 8 in the hundred's place may be identified by substituting a 7 and then identifying the numbered structure in FIG. 13.

In the embodiment of the invention herein illustrated, ring-like elements 730, 830, 630, 300*p* and 300*d* all have the same width. This width is illustrated to be twice the diameter of tumbler bores 733, 833, 633, 333*p*, and 333*d*, which here all have the same diameter. The ring-like elements, however, need not all have the same width, and the bores need not all have the same diameter, nor do the bores or tumblers need necessarily to be substantially cylindrical. The placement of each bore along core 20 may be described by means of a reference point, these reference points all lying in a single plane perpendicular to face 212, and each point being the geometrical center of gravity of the figure described by that point's respective bore when that bore is cut by the aforesaid single plane, the plane preferably intersecting the bores perpendicularly as well. For the cylindrical bores shown here in core 20, these reference points reduce simply to the midpoints of the circles described in a plane chosen to cut the bores perpendicular to the shared plane of the bores' axes.

Figure 14:
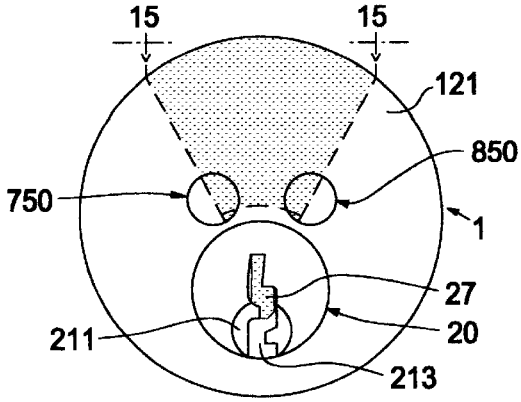
FIG. 14 is a front plan view of the embodiment of FIG. 1 with the key thereto removed
Figure 15:
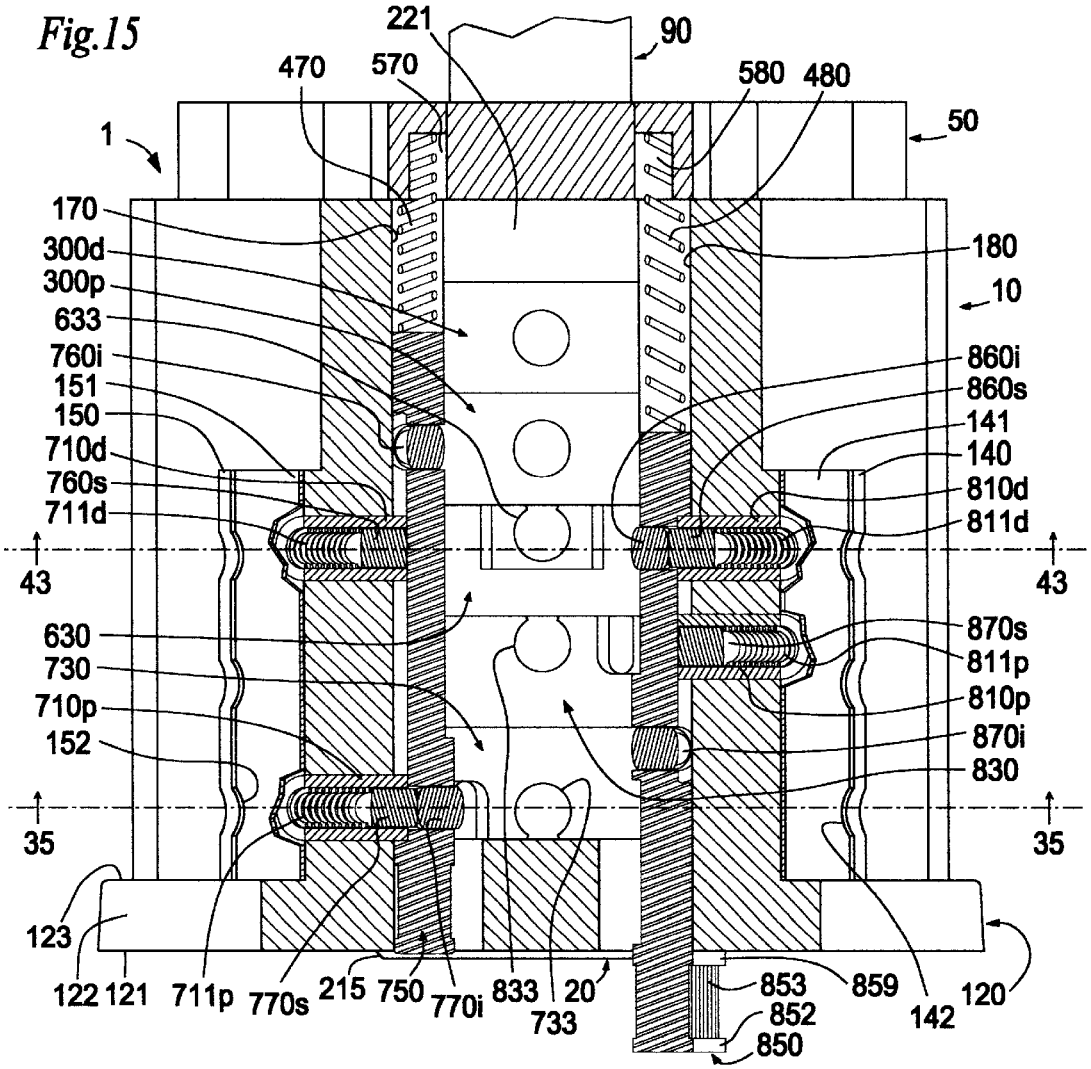
FIG. 15 is a top, plan, partial cutaway view of the embodiment of FIG. 1 taken along line 15—15 of FIG. 14 and with the shaded portions of FIG. 14 removed and with two like elements partially broken away.

FIG. 14 shows dashed cut-lines applied to lock 1 in order to define FIG. 15. Note that the straight cut-lines pass through diameters of pop-ups 750 and 850, so that one half of each pop-up will be removed. The circular-arc cut-line between the straight cut-lines has a radius slightly greater than that of the outermost surfaces of the ring-like elements of lock 1 and in fact equal to the radius of bore 103 (preview FIG. 26). Proximal tumbler 27 shows through keyway 213 because no key is in the lock. All lock pins and tumblers have been removed in FIG. 15, since the drawing would be cluttered pointlessly by their crosssections.

FIG. 15 shows all the elements of lock 1 thus fair described. Additionally, springs 470 and 480 are seen to be respectively compressed and extended against distal faces 756 and 856 (see FIGS. 6 & 3) of pop-ups 750 and 850. When compressed against their respective pop-ups 750 and 850, springs 470 and 570 urge pop-ups 750 and 850 out of lock 1, unlike the springs in the prior art discussed above. Springs 470 and 480 may be fairly stiff and need not be able to extend much farther than shown here by extended spring 480. This is because springs 470 and 480 accomplish their work by impulse upon release from a compressed state. Pop-up 750 is shown to be armed and nearly flush with face 121 of flange 120, while pop-up 850 is shown fully extended beyond face 121, having been triggered. Pop-up 850, indicates, by means of colored band 853, that entry into the space protected by lock 1 has been sought and/or obtained. Springs 470 and 480 nestle snugly in bind-hole pockets 570 and 580 of rear plate 50, thus maintaining these springs' alignment with the axes of their respective pop-ups. Cylindrical pop-up bores 170 and 180 extend the length of lock body 10 and flange 120.

Distal, lower pop-up pins 760*i* and 860*i* reside in pop-up bores 729 and 829 (see FIGS. 6 and 3), respectively. Proximal, lower pop-up pins 770*i* and 870*i* reside in bores 721 and 821 (see FIGS. 6 and 3), respectively.

Resting perpendicularly on trough bottom 722 (see FIG. 6) are distal and proximal tubular pin sleeves 710*d* and 710*p*. Residing within sleeves 710*d* and 710*p* are, respectively, distal, upper pop-up pin 760*s* and proximal upper pop-up pin 770*s* (s=supra and i=infra throughout the specification). Distal and proximal pin springs 711*d* and 711*p* press down, respectively, upon pins 760*s* is and 770*s*. Springs 711*d* and 711*p* are held compressed by hold down 151, here shown partly broken away. Hold down 151 does not in fact touch sleeves 710*d* and 710*p* (preview FIGS. 24 and 25), only springs 711*d* and 711*p*.

All pop-up pins and sleeves of lock 1 are toleranced to slide freely within their containments (the pins within the sleeves, the sleeves within lock body 10). The fact that pop-up 750 is under spring pressure from behind when armed coupled with these tolerances gives rise to the slight extension (about 0.004" in actual practice) of pop-up 750 beyond face 121, as shown here and in FIG. 1, being depicted with a slight, optional bevel. (Pop-up 850 is depicted without a bevel). The spring pressure takes up, so to speak, the "slack" of the tolerances.

Distal bottom pin 760*i* rests on the outer surface 332*p* of plain ring 300*p* (see FIG. 11). Proximal bottom pin 770*i* rests on the body 220 (see FIG. 9) of core 20 seen here through the U-shaped aperture of trigger 740 of trigger means 730*i* (see FIG. 13). Pop-up 750 is prevented from shooting forward by pin 770*s*, which extends a distance into bore 721 of pop-up 750 (see FIG. 6).

Resting perpendicularly on trough bottom 822 (see FIG. 3) of pop-up 850 are distal and proximal tubular pin sleeves 810*d* and 810*p*, identical to each other and to the sleeves for pop-up 750. Residing within sleeves 810*d* and 810*p* are, respectively, distal upper pop-up pin 860*s* and proximal upper pop-up pin 870*s*. Distal and proximal pin springs 811*d* and 811*p*, identical to each other and to the springs for pop-up 750, press down, respectively, upon pins 860*s* and 870*s*. Springs 811*d* and 811*p* are held compressed by hold down 141, here shown partly broken away. Hold down 141 does not in fact touch sleeves 810*d* and 810*p*, only springs 811*d* and 811*p*.

Distal bottom pin 860*i* rests on surface 632 of reset ring 630 (see FIG. 12). Proximal bottom pin 870*i* rests on surface 732 of trigger means 730. Pop-up 850 has already been triggered, as shown also in FIG. 1.

Bottom pins 770*i* and 870*i*, when these pins' respective pop-ups are pressed flush with face 121, as happens when the pop-ups are pressed in to be reset, i.e. rearmed, drop into their respective trigger apertures 740 and 840. When the proximal cylindrical wall of a pop-up's trough encounters a proximal pin-sleeve as the pop-up is being pressed in for resetting, the proximal pin-sleeve prevents the pop-up from being pressed in still farther, and the spring within the pin-sleeve pushes the upper pin down into the proximal bore in the pop-up (preview FIG. 25). After pins 770*s* and 870*s* have been pushed down into bores 721 and 821 of their respective pop-ups, forward motion by these pop-ups is obstructed. This pin action, namely of lockably arming the po-pups, is the sole function of the proximal pop-up pins.

A comparison of FIGS. 5, 8, and 11–13 with FIG. 15 reveals that trigger means 830 is free to turn beneath both the pop-ups, plateau 831 and core tumbler 28 (preview FIG. 19) passing immediately behind blocking portion 854 of pop-up 850. Trigger means 730 is also free to turn under pop-up 850, however it is blocked in FIG. 15 by blocking portion 754 of pop-up 750 (see FIGS. 6–8) from turning beneath pop-up 750 (preview FIG. 35), because pop-up 750 is armed. Reset means 630 never encounters blocking portions 754 or 854, and thus is always free to turn under both pop-ups. However its plateaus may encounter the bottom pin of an already triggered and extended pop-up (preview FIG. 35), here 860*i*. The plateaus of reset means 630 do not fully extend across ring 630, but only somewhat beyond the center line (see also FIG. 12). This is to prevent these plateaus from running into blocking portion 854 of pop-up 850 when pop-up 850 is in its armed position. Line 43—43 is the center line of pins 760*s* and 860*s*, and these pins' associated sleeves and springs. Reset plateaus 631*l*, 631*t*, and 631*r* are always able to lift whichever of pins 760*i* and 860*i* rests currently upon surface 632 of reset ring 630, or to lift both pins.

FIG. 15 also nicely shows the chamfers of bores 733, 833, and 633, introduced in FIGS. 12 and 13.

Figure 16:
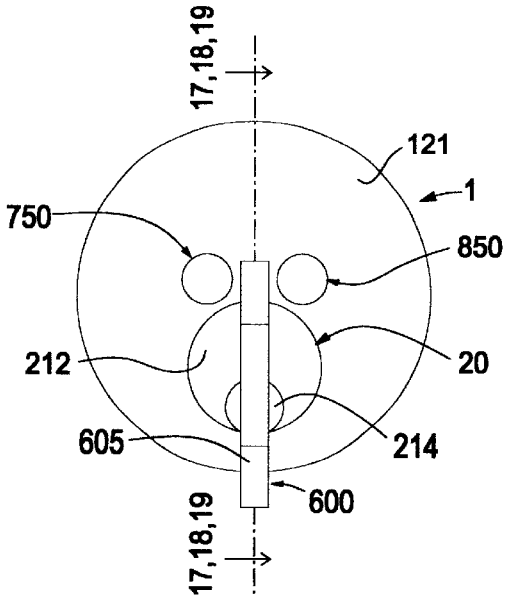
FIG. 16 is a front plan view of the embodiment of FIG. 1 but with a different key thereto inserted
Figure 17:
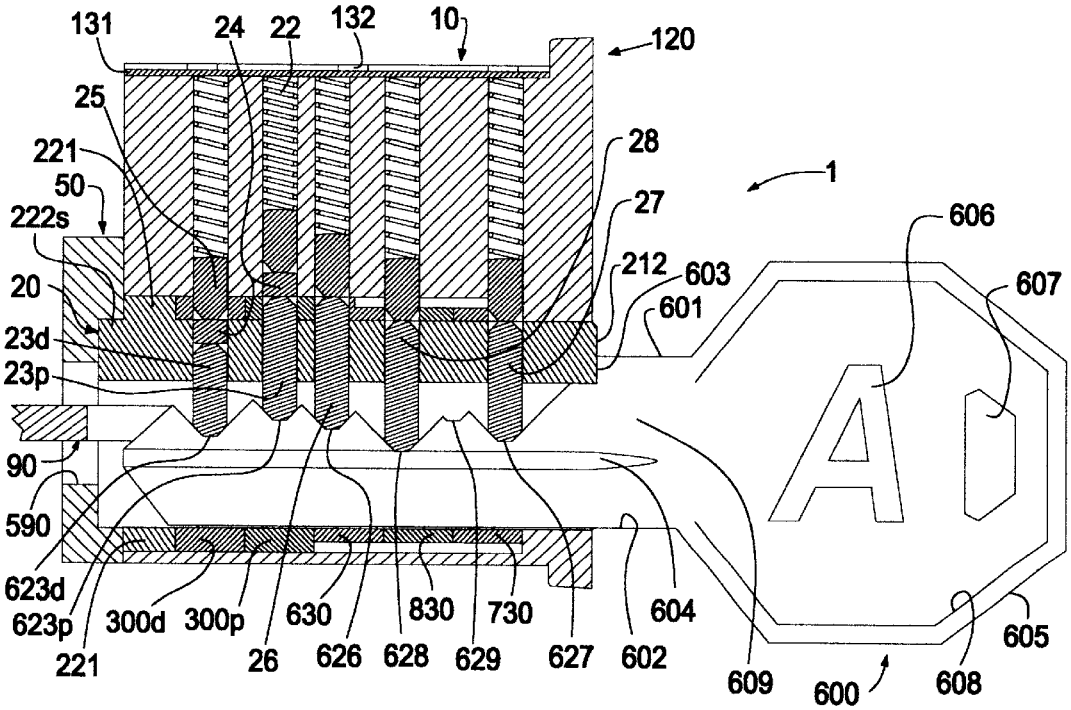
FIG. 17 is a cross-sectional view of the embodiment of FIG. 1, taken along line 17—17 of FIG. 16, and with the key of FIG. 16 inserted into the lock but with the key not cross-sectioned.
Figure 18:
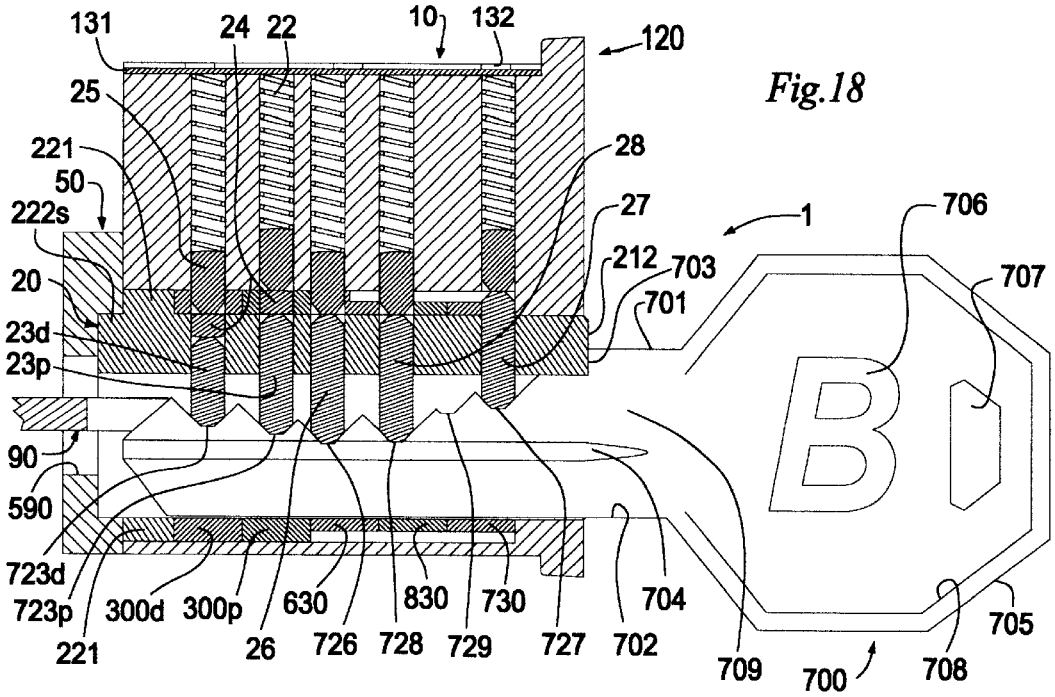
FIG. 18 is a cross-sectional view of the embodiment of FIG. 1, taken along line 18–18 of FIG. 16, but showing a different key than the keys in FIGS. 1 and 17 inserted into the lock and with the key not cross-sectioned.
Figure 19:
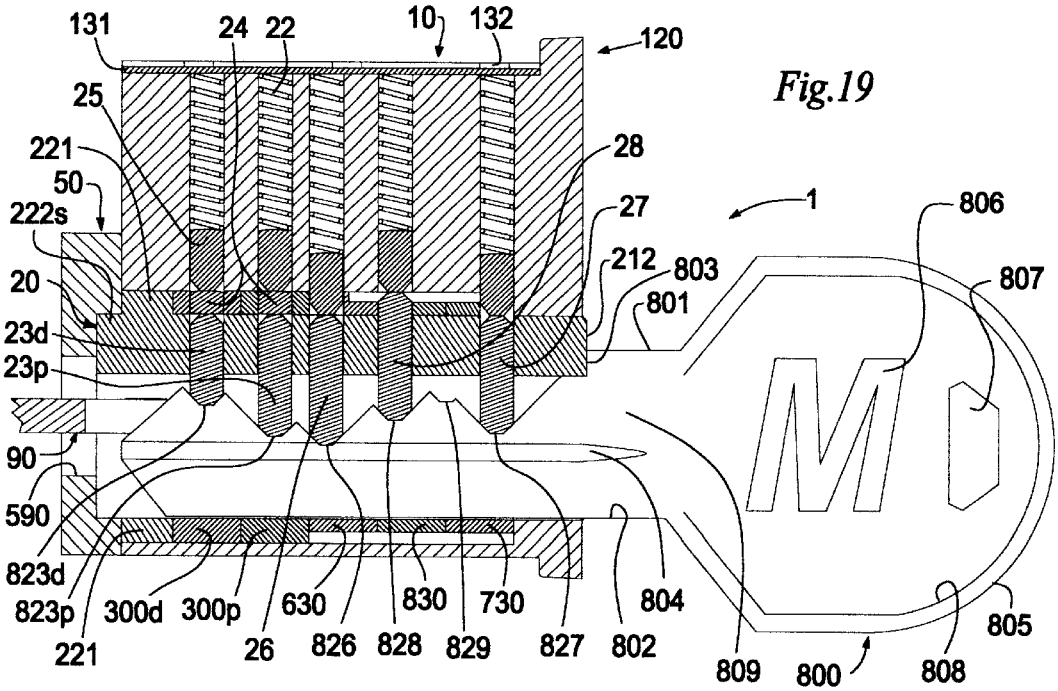
FIG. 19 is a cross-sectional view of the embodiment of FIG. 1, taken along line 19—19 of FIG. 16, and showing the key in FIG. 1 inserted into the lock and with the key not crosssectioned.

FIG. 16 defines cross-sectional FIGS. 17–19, which are taken along line 17,18,19–17,18,19. A-Key 600 is shown in lock 1, just as it is in FIG. 17. In FIG. 18 B-key 700 has been inserted into lock 1 instead, and in FIG. 19 M-key 800 has been inserted. The keys themselves are not cross-sectioned.

FIG. 17 shows A-key 600 having essentially octagonal grip 605, blade 609 with flat, top and bottom surfaces 601 and 602, warding cut 604, and flat surface 603 which abuts face 212 of core 20 and is orthogonal to surface 601. Line 608 is decorative.

Blade 609 has angular keycuts 627, 628, 626, 623*p*, and 623*d* that communicate with tumblers 27, 28, 26, 23*p* and 23*d*, respectively, in the usual manner. Each tumbler 27, 28 or 26 communicates with a top pin 25, all five top pins being identical. Tumblers 23*p* and 23*d* and their top pins 25 are, separated by identical mid-pins 24 in order to generate additional combinations, in the usual manner. Identical tumbler springs 22, retained by hold-down 131 by means of crimped tabs 132, keep the tumblers pressed against their respective keycuts in key blade 609. Unlike the tumblers and the two mid-pins, top pins 25 are asymmetric, in that their tops are crowned to meet springs 22, while their bottoms are angled, like the symmetric, angular ends of the five tumblers. Given the lock-combination shown, only ring-like elements 300*p* and 630 will turn with core 20 when key 600 is turned. Key 600 will always turn ring-like element 630, the reset ring, but may or may not turn either or both of plain rings 300*p* and 300*d*. Key 600 never turns trigger means 730 or 830.

FIG. 17 further shows that core 20 is retained in lock 1 by stop ring 221 and rear plate 50. If core 20 were of uniform diameter, forcibly extracting it with a dent-puller would be relatively easy, inasmuch as only one tumbler might in fact retain core 20 (this would be the case for tumbler 27 in FIG. 18). The usual lock core has a flange surrounding its proximal end and a clip at its distal end that together retain the core in both directions. Lock 1 improves upon this arrangement by omitting the flange and clip altogether and instead retaining core 20 with the much-stronger combination of stop ring 221 and rear plate 50. This also allows assembly of lock 1.

FIG. 18 shows B-key 700 inserted Into lock 1 and having features, apart from keycuts 727, 728, 726, 723*p*, and 723*d*, that are identical to the features of A-key 600, these identical features being numbered identically following the hundred's place. B-key 700 has in its essentially octagonal grip a punched letter B instead of an A as its distinct, identifying aperture. Note that, when B-key 700 is turned, ring-like element 730 will turn with core 20. For B-key 700 and ring-like element 730, which is the trigger ring for pop-up 750, this will always be the case. B-key 700 may or may not turn either or both of plain rings 300*p* and 300*d*. B-key 700 never turns trigger 830 or reset ring 630.

FIG. 19 shows M-key 800 inserted into lock 1 and having features, except for keycuts 827, 828, 826, 823*p*, and 823*d*, and except for rounded grip 805, that are identical to the features of A-key 600, these identical features being numbered identically following the hundred's place. Rounded grip 805 has the letter M punched therein as key 800's identifying aperture. The A, B and M keys are thus easily distinguished visually and tactilely. Note that, ring-like element 830 will turn with core 20 when M-key 800 is turned. For M-key 800 and ring-like element 830, which is the trigger ring for pop-up 850, this will always be the case. M-key 800 may or may not turn either or both of plain rings 300*p* and 300*d*. M-key 800 never turns trigger 730 or reset ring 630.

A consequence of placing triggers 730 and 830 back to back, a necessary placement if all of the keys are to remain rotatable regardless of the armed or shot-forward positions of the pop-ups, which is to say regardless of the current positions of blocking portions 754 and 854 (see FIGS. 5, 8, and 15), is that a substantial gap arises between tumblers 27 and 28, visible in FIGS. 17–19. The tumblers of lock 1 thus form an asymmetric, linear array. Hence it becomes possible to create a dummy keycut in each of lock 1's keys, namely dummy keycuts 629, 729, and 829, respectively, which dummy keycuts may be varied in depth independently and over a substantial range. Anyone not thoroughly familiar with lock 1's construction (and even then) will have a devil of a time picking it, not to mention doing so without triggering a pop-up.

Figure 20:
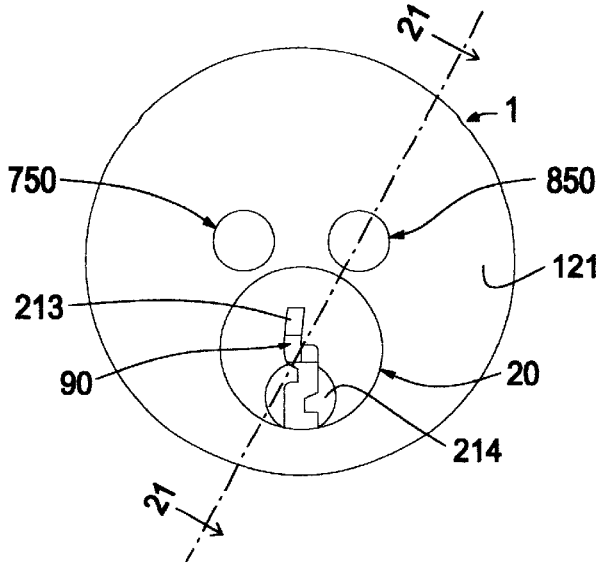
FIG. 20 is a front plan view of the embodiment of FIG. 1 with the key and tumblers thereof removed.

FIG. 20 shows lock 1 with all pins and tumblers removed, so that tail-piece 90 shows through keyway 213. The cut line 21—21 runs through a diameter of pop-up 850 and through the center of core 20.

Figure 21:
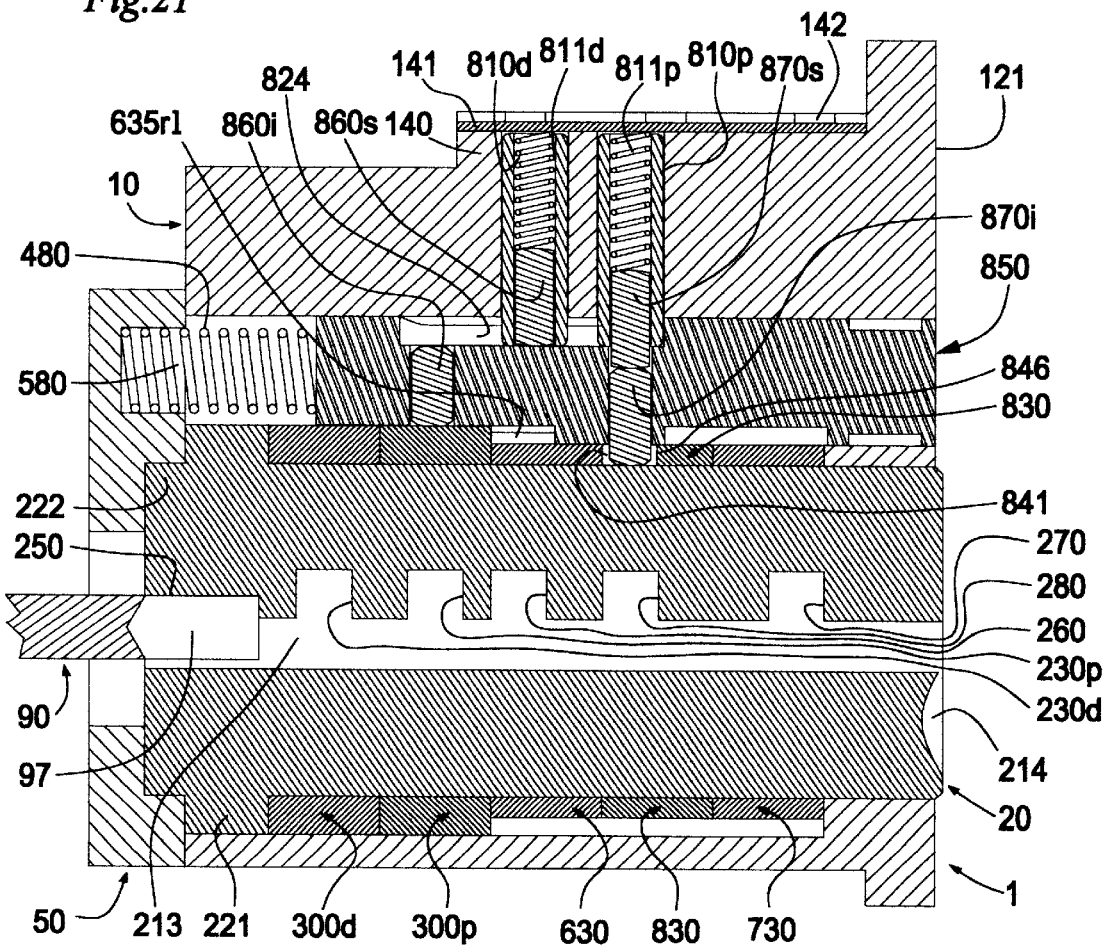
FIG. 21 is a cross-sectional view of the elements in FIG. 20 taken along line 21—21 of FIG. 20.

FIG. 21 is taken along line 21—21. Core bores 270, 280, 260, 230*p* and 230*d*, emptied of tumblers in order to avoid depicting arbitrary, tumbler cross-sections, are shown here for the sake of verisimilitude. In its armed position pop-up 850 actually would protrude very slightly beyond face 121. This is because, as described above, pop-up pins 870*s* and 870*i* must be toleranced to slide freely. In the armed position, with spring pressure taking up the slack of available tolerances, actual contact will be made by bore 821 (see FIG. 3) pressing on pin 870*s* from behind, causing pin 870*s* to make contact with the proximal inner surface of sleeve 810*p*. Sleeve 810*p* will in turn be pressed against the proximal side of its bore in lock 1.

As shown in FIG. 21, pop-up 850 has momentarily been pressed back into lock 1 and is being held pressed in, with pins 870*s* and 870*i* and sleeve 810*p* thus free to center within their containments. The position of these elements in lock 1 is so arranged that pin 870*i*, smaller in diameter than the tumblers, now lies a about in the middle of the U-shaped aperture of trigger 840. Pin 870*i* will thus not make contact with surface 846, even when bore 821 presses on pin 870*s* from behind, because the combined slack of the tolerances is smaller by a factor of 2 or so than the distance of pin 870*i* from face 846. Thus, pin 870*i* will not bind against means 830 when lifted by either of the beveled faces 841 or 842 of trigger 840.

FIG. 21 further shows that pocket 580 in rear plate 50 keeps spring 480 centered on pop-up 850. Pocket 570 has the same effect on spring 470.

Figure 22:
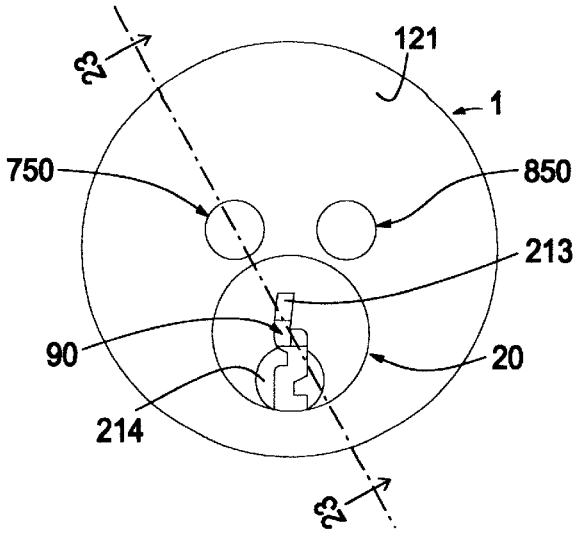
FIG. 22 is a front plan view of the embodiment of FIG. 1 with the key and tumblers thereof removed.
Figure 23:
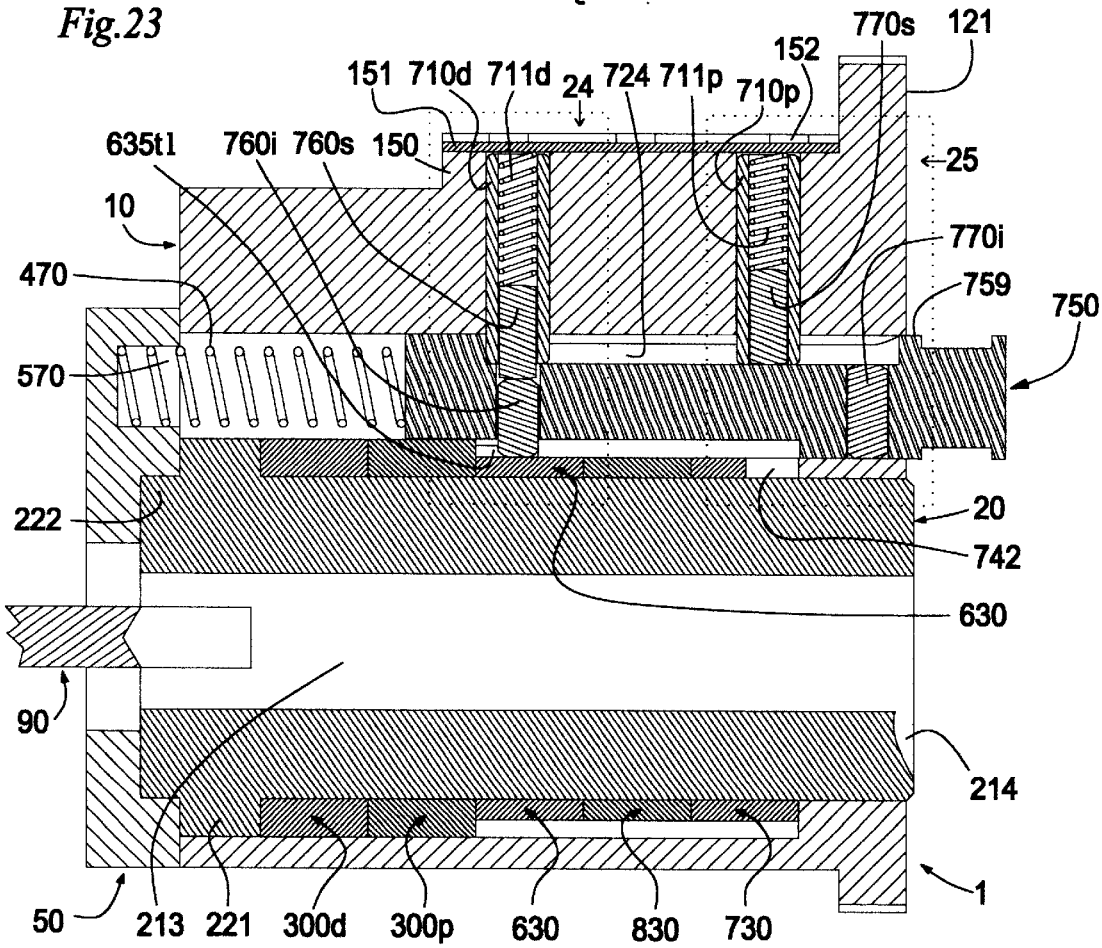
FIG. 23 is a cross-sectional view of the elements of FIG. 22 taken along line 23—23 of FIG. 22.

FIG. 23 is analogous to FIG. 21, except that cut line 23—23 in FIG. 22 just bypasses the core bores. Pop-up 750 is prevented from moving farther forward by the contact of distal cylindrical wall 727 of trough 720 (see FIG. 6) with sleeve 710*d*. Pin 760*i* has been driven down upon reset ring 630 by pin 760*s*, which in turn is driven down by spring 711*d*. Visible behind pin 760*i* is reset plateau 635*tl*. Plateau 635*tl* is able to lift pin 760*i*, allowing pop-up 750 to be reset (preview FIG. 43).

Sleeve pairs 710*d* and 710*p*, lying between side walls 723 and 724 of trough 720 (see FIG. 6), prevent pop-up 750 from rotating. Sleeves 810*d* and 810*p* perform this same function for pop-up 850, via side walls 823 and 824 of trough 820.

Figure 24:
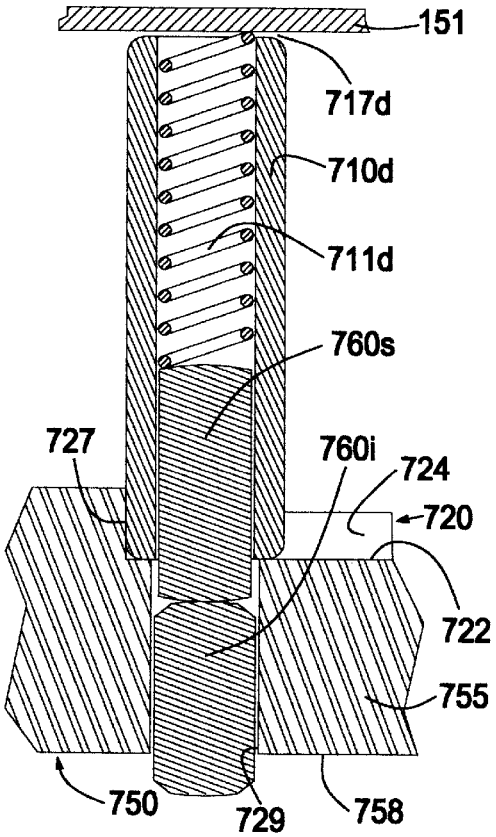
FIG. 24 is an enlarged and partly fragmentary view of several of the elements seen in dotted box 24 of FIG. 23.

FIG. 24 shows distal sleeve 710*d*, pins 760*s* and 760*i*, and spring 711*d* of pop-up 750 after pop-up 750 has been triggered. Sleeve 710*d* is lengthwise so toleranced that gap 717*d* arises between it and hold down 151. Were gap 717*d* not present, hold-down 151 would press sleeve 710*d* down upon trough bottom 722 so that pop-up 750 could not slide forward freely when triggered. Gap 717*d* is thus essential, and is replicated in all: four sleeves.

The inside diameter of sleeve 710*d* is slightly less than the diameter of bore 729, and the diameter of pin 760*s* is slightly less than the diameter of pin 760*i*. These diameter relations insure that pin 760*s* will drive into bore 729 the instant before sleeve 710*d* stops distal cylindrical wall 727 of trough 720 from shooting farther forward. When pin 760*s* is inside bore 729 it locks pop-up 750 against being pressed in.

After wall 727 and sleeve 710*d* have made contact, trigger means 730 will just clear blocking portion 754 of pop-up 750 (see FIGS. 6 and 15). Pop-up 750 will, however, already have locked the instant before this occurs. Indicator lock 1 thus cannot be defeated by turning, say, key 700, keeping it pressed against pop-up 750, all the while trying to let pop-up 750 slowly move forward against spring 470, hoping just to sneak past blocking portion 754 and then quickly to press pop-up 750 back into lock 1. In the moment when key 700 can turn past blocking portion 754, pop-up 750 will already have locked. Exactly the same is true of pop-up 850 and key 800.

The ends of sleeve 710*d* are rounded to permit pop-up 750 to slide easily underneath it. This rounding is replicated in all four sleeves.

Top pin 760*s* is crowned at both ends to permit pop-up 750 to slide easily underneath it when triggered, no matter which end of pin 760*s* gets pointed downwards during lock assembly. This crowning is replicated in all four pins 760*s*, 770*s*, 860*s*, and 870*s*.

Figure 43:
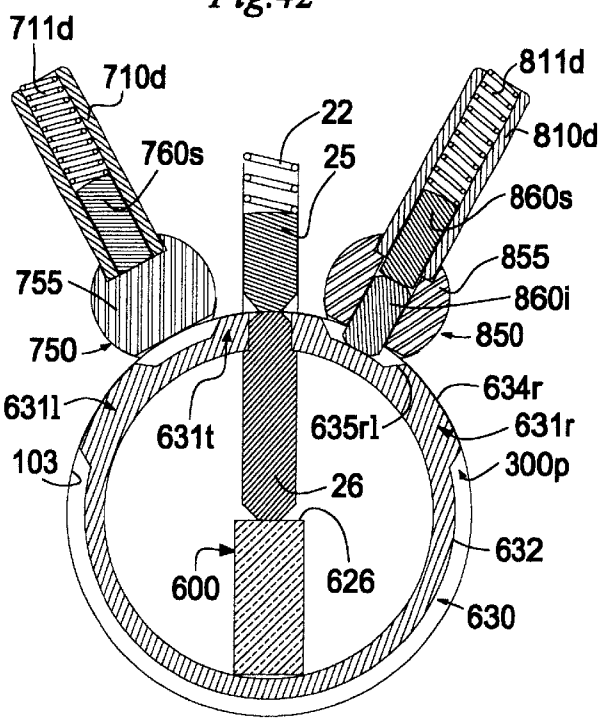
FIG. 43 is a cross-sectional view taken along line 43—43 of FIG. 15, but taken prior to the removal of the portions shaded in FIG. 14 and showing the moving parts of the embodiment of FIG. 1. intersected by line 43—43 and before being moved.

Bottom pin 760*i* has beveled at both ends so that it can be lifted by the reset plateaus (preview FIG. 43). This beveling is replicated in all four pins 760*i*, 770*i*, 860*i*, and 870*i*.

Figure 25:
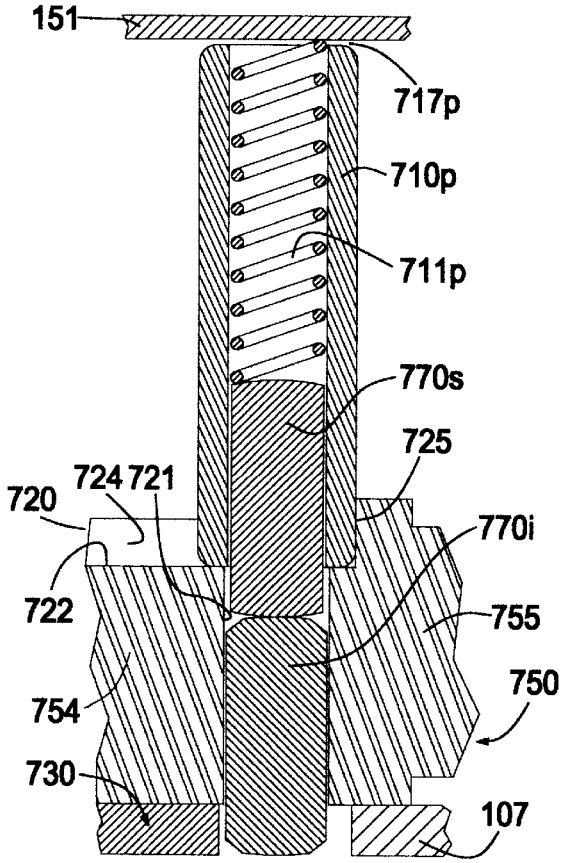
FIG. 25 is an enlarged and partly fragmentary view of several of the elements seen in dotted box 25 of FIG. 23, but as these elements are interrelated in FIG. 15.
Figure 36:
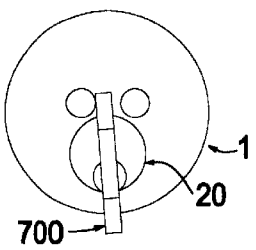
FIG. 36 shows the key and core of FIG. 34 slightly counterclock-wise rotated with respect to the remaining elements of the lock.
Figure 37:
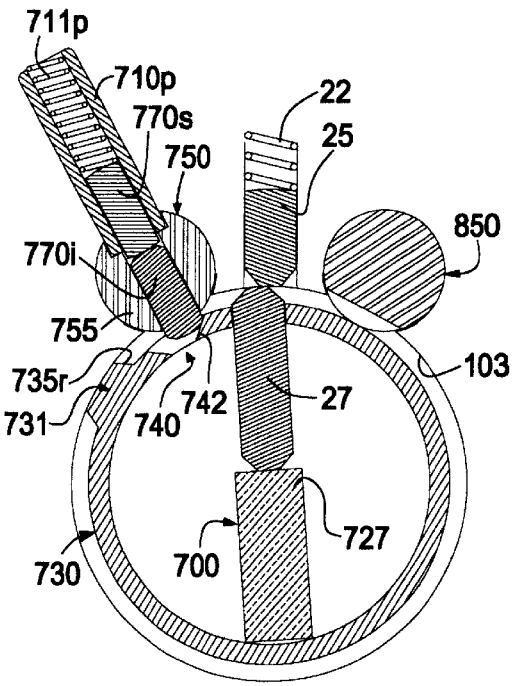
FIG. 37 shows the moving parts of FIG. 35 rotated as in FIG. 36.
Figure 34:
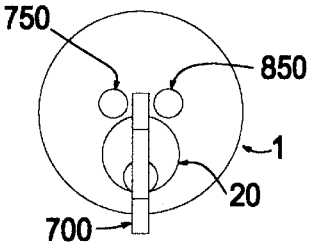
FIG. 34 is a front, plan view of the embodiment of FIG. 1 but with the key of FIG. 18 inserted into the core.

FIG. 25 shows that the diameter relations with respect to distal sleeve 710*d* and pins 760*s* and 760*i* are replicated with respect to the proximal sleeve 710*p* and pins 770*s* and 770*i*. These relations are all in turn replicated for pop-up 850. As shown in FIG. 25, pop-up 750 has been pushed in as far as it will go while being reset. A portion of the thinnest section 107 of lock 1 (preview FIGS. 26 & 27) is seen, as well. The distance of pin 770*i* from section 107 well exceeds the tolerance: slack that will be taken up when pop-up 750 comes under spring pressure. Pin 770*i* will thus not bind on section 107.

Pins 760*s* and 860*s* and sleeves 710*p* and 810*p* are responsible for blocking movement of pop-ups 750 and 850, respectively, into lock 1. Similarly, pins 770*s* and 870*s* and sleeves 710*d* and 810*d* are responsible for blocking movement of pop-ups 750 and 850, respectively, out of lock 1. All of these elements, furthermore, remain under spring pressure, which tends to shear them. Thus, they should be strong, as should trigger means 730 and 830. Stainless steel is these elements' material of choice, extruded, drawn, or sintered. The remaining elements of lock 1, apart from the springs, may be made of suitable brass alloys. Locks on exterior doors get exposed to rain.

FIG. 26 depicts lock body 10 and integrally formed flange 120 in order to show the placement of the lengthwise bores of lock 1. Tom Bore 103 accepts the ring-like elements which ride upon core 20 and is very sightly greater than them in diameter. Bore 104 is very slightly greater in diameter than core body 220. Pop-up bores 170 and 180 hold, respectively, pop-ups 750 and 850 within lock 1 and are toleranced to let the pop-ups just slide freely within them. Where pop-up bore 170 approaches closest to bore 104 is thinnest-section 107 of lock 1. Section 107 is short, however. An analogous section 108 arises for pop- up bore 180 (see FIG. 27).

Bores 105 and 106 are threaded to accept screws 555 and 556 (see FIG. 2). 161 and 162 are little, hemispherical pockets seen best in FIG. 29.

FIG. 27 shows asymmetrically spaced-apart, spring-and-pin bores 127, 128, 126, 123*p*, and 123*d*. Threaded bores 102 and 101 (see also FIGS. 2 and 26) are depicted for standard, lock, mounting screws. These bores start life as short, blind holes that are then drilled out and tapped. They can easily be made narrower if dedicated mounting screws are supplied with the lock. They are shown here in their closest approach to pop-up bores 180 and 170.

FIG. 28 shows threaded bores 105 and 106 for screws 555 and 556.

FIG. 30 shows rear plate 50, which allows indicator lock 1 to be assembled. Bores 505 and 506 in rear plate 50 are for screws 555 and 556. Locator dimples 561 and 562 fit in pockets 161 and 162. Tail-piece 90 extends through bore 590. Core rear portion 222 turns in cylindrical pocket 504. Blind-hole pockets 570 and 580 position springs 470 and 480.

FIGS. 31–33 show these feature in greater detail and add counter sinks 515 and 516 for cap-screws 555 and 556.

Figure 35:
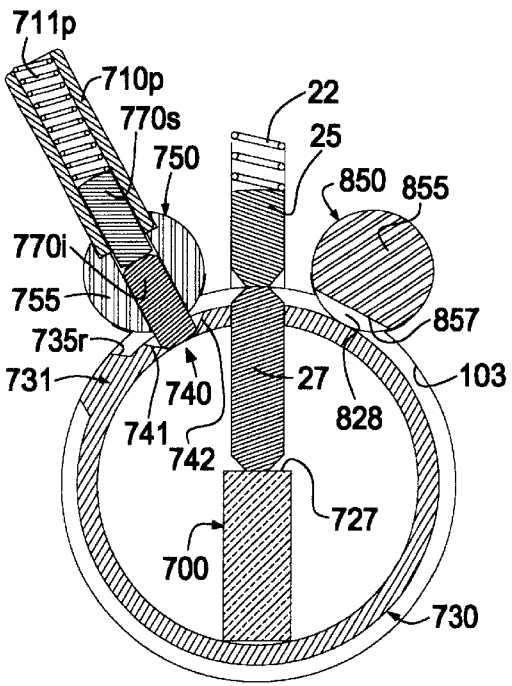
FIG. 35 is a cross-sectional view taken along line 35—35 of FIG. 15, but taken prior to the removal of the portions shaded in FIG. 14 and showing the moving parts of the embodiment of FIG. 1. intersected by line 35—35 and before being moved.
Figure 40:
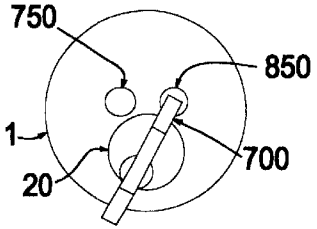
FIG. 40 shows the key and core of FIG. 38 counterclockwise rotated with respect to the remaining elements of the lock and nearly back to their position in FIG. 34.
Figure 39:
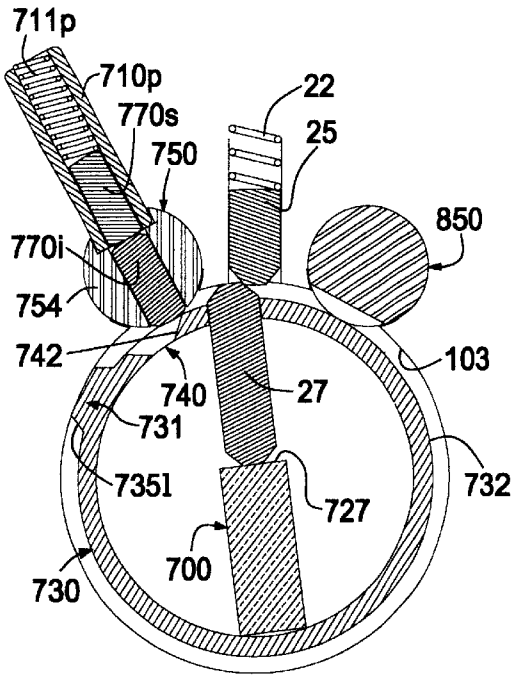
FIG. 39 shows the moving parts of FIG. 37 rotated as in FIG. 38.

In the rotation sequence of FIGS. 35, 37, 39, and 41, key 700 is respectively positioned as in the upper rotation sequence FIGS. 34, 36, 38, and 40, wherein FIG. 40 shows a nearly complete rotation. In FIG. 35 pop-up 750 is armed, with pin 770*i* seated in trigger aperture 740. As key 700 is rotated counterclockwise beveled face 742 encounters beveled pin 770*i* and begins to lift it against spring 711*p*. In FIG. 39, pin 770*i* has been lifted just sufficiently to allow pop-up 750 to shoot forward. Since pin 770*i* is beveled and pin 770*s* is crowned, pop-up 750 shears easily past their point of contact. Pop-up 750 glides underneath sleeve 710*p*, with pin 770*i* ending up inside bore 170 (see FIG. 23), in the region of thinnest section 107 (see FIG. 27). Should pop-up 750 be held pressed in, tumbler 27 will be prevented from rotating by blocking portion 754 of pop-up 750. Likewise, but in the opposite direction, plateau 731 will also be blocked from rotating. Both directions of rotation must be accounted for to insure that lock 1 may be substituted for any standard lock cylinder, regardless of application.

In FIG. 39, top pin 25 has begun to lower onto surface 732 of trigger 730. Top pin 25 and tumbler 27, as well as tumblers 28, 26, 23*p* and 23*d*, all have the same diameter, this being greater than the diameters of pop-up pins 770*i*, 770*s*, 870*i*, 870*s*, and 760*i*, 760*s*, 860*i* and 860*s*.

Figure 41:
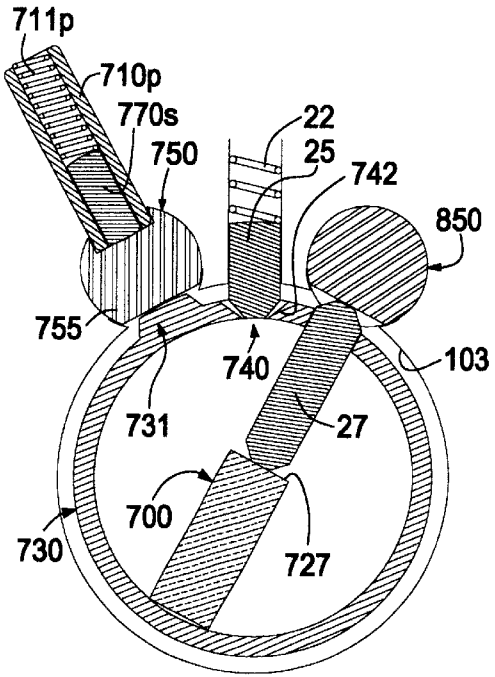
FIG. 41 shows the moving parts of FIG. 39 rotated as in FIG. 40.
Figure 38:
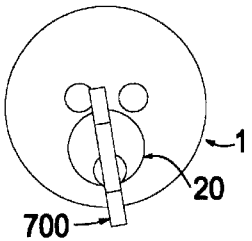
FIG. 38 shows the key and core of FIG. 36 slightly counterclock-wise rotated with respect to the remaining elements of the lock.

In FIG. 41 pop-up 750 has been shot fully forward. Pin 25 has ridden up and over plateau 731, bevel 7351 having come into contact with pin 25 first, lifting it. Pin 25 now extends into aperture 740, from which it is lifted up by beveled face 742. Since pin 25 and tumbler 27 share the same midline, beveled tumbler 27 will lift beveled pin 25 on encountering it, so that a complete core rotation may be achieved. Pin 25 is asymmetric, its top being crowned, so that it does not bind against spring 22.

Figure 44:
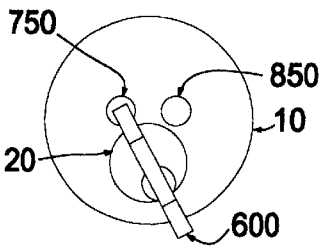
FIG. 44 shows the key and core of FIG. 42 slightly counterclockwise rotated with respect to the remaining elements of the lock, such that the key lines up with the left indicator element introduced in FIG. 1.
Figure 45:
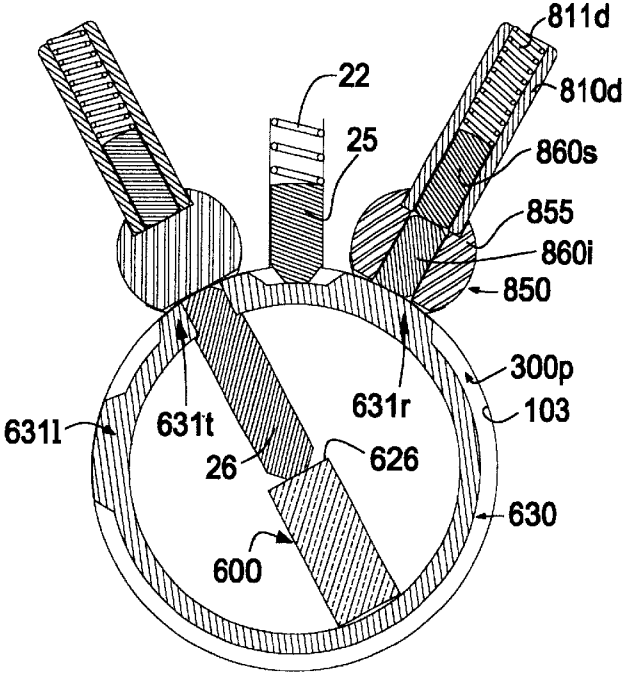
FIG. 45 shows the moving parts of FIG. 43 rotated as in FIG. 44.
Figure 42:
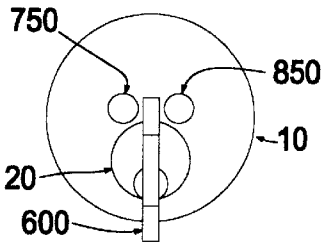
FIG. 42 is a front, plan view of the embodiment of FIG. 1 but with the key of FIG. 17 inserted into the core.

In the reset rotation-sequence of FIGS. 43 and 45, key 600 is respectively positioned as in the upper rotation sequence of FIGS. 42 and 44. In FIG. 43 pop-up 850 is shown shot forward, with pin 860*i* resting on surface 632 of reset ring 630. The owner turns A-key 600 so that it aligns with the pop-up opposite to the one to be reset, aligning here with 750, thus allowing a finger tip or penny to be pressed against extended pop-up 850. Bevel 635*rl* of plateau 631*r* lifts pin 860*i* until it rides up onto top surface 634*r*, as in FIG. 45. Pop-up 850 may now be pressed back into bore 180 until it locks into armed position. Pin 860*i* will come to rest on surface 332*p* of plain ring 300*p* (see FIG. 11). This rearming of pop-up 850 is entirely optional. A-key 600 will turn fully around whether or not the pop-up is reset, pins 25 and 860*i* riding up and down, over plateaus 631*l*, 631*t*, and 631*r*. This action will feel different, however, than if only one pin, namely pin 25, rode up and down. Thus, the lock-owner receives an additional tactile cue that entry has been sought. The cue is delivered whether key rotation is clockwise or not, a quarter of a turn or more than that, because pin 860*i* rests between reset plateaus spaced about 450 apart. The same result obtains for pop-up 750, or for both pop-ups together.

If the reset-procedure just described is attempted with key 700 or with key 800, reset ring 830 will not rotate. The rotation neither of key 700 in lock 1 nor of key 800 in lock 1 permits a movement either of pop-up 750 or of pop-up 850 from the respective pop-up's extended, indicator, position back to its armed position. Only a rotation of key 600 permits such a movement. When to effect this movement remains optional.

FIG. 46 summarizes the key-functions of indicator lock 1.

FIG. 47 depicts lock 2 and shows core 20, single pop-up 750, and tumbler 27. Core 20, pop-up 750, and in fact all of the a tumblers of lock 1 get reused in lock 2 and thus they retain here their original numbering. However, only keys 600 and 700 get reused, key 800 having lost its raison d'etre.

FIG. 48 shows lock 2 opened up as per FIG. 47. Attached to body 12 is rear plate 52, which now has but one pocket 2570 to hold and align spring 470. Pop-up 750, spring 470, ring-elements 730, 630, 300*p*, and 300*d* of lock 1, plus sleeves 710*d* and 710*p*, pins 760*s*, 760*i*, 770*s*, and 770*i*, and springs 711*d* and 711*p* of lock 1 all get reused in lock 2 and function exactly as they did in lock 1. Although ring-element 830 no longer functions as a trigger means, it is kept here so that pin 770*i* can slide back onto surface 832 when pop-up 750 is armed. Similarly, reset means 630 no longer has to have plateau 631*r*, there being no pop-up 850 to reset. That all of lock 1's ring-elements are kept unchanged here is an acknowledgment of the economic likelihood that wasting a small amount of metal may be cheaper than purchasing new tooling.

FIG. 49 shows lock body 12, similar to body 10, but having only the one pop-up bore 2170 and one pop-up head 2150. Body 12 has right and left facets 2113*r* and 2113*l*, and right and left facets 2114*r* and 2114*l*, of which only the last carries a pop-up head, namely 2150. Pop-up head 2150 supports hold down 151, reused from lock 1, which it secures with tabs 2152, exactly in the manner of body 10. Tumbler head 2130 supports hold down 131, reused from lock 1, which it secures with tabs 2132, exactly as in the manner of body 10. Body 12 has threaded bores 2101, 2102, 2105, and 2106, which function exactly as bores 101, 102, 105 and 106 do in body 10. Small hemispherical holes 2161 and 2162 function exactly as holes 161 and 162 function in body 10. Body 12 has flange 2120, which is similar to flange 120, except that only one bore, namely bore 2170, extends through flange 2120. Pop-up bore 2170 holds pop-up 750 within lock 2 and is toleranced to let pop-up 750 just slide freely within it. Bore 2103 encloses the ring-like elements which ride upon core 20 and is very sightly greater than them in diameter, as before. Bore 2104 is very slightly greater in diameter than core body 220, as before. Where pop-up bore 2170 approaches closest to bore 2104 is thinnest-section 2107 of body 12. Section 2107 is short.

Lock 1 and lock 2 may both be easily built with metal stampings replacing the cast or sintered back plates 50 and 52, respectively.

Since these and other changes and modifications apparent to one skilled in the art may be made in the herein described embodiments of the invention without departing from the scope and true spirit thereof, it is intended that all matter contained herein be interpreted in an illustrative, and not in a limiting, sense with respect to the invention claimed in the following claims and equivalents thereto.

I claim:

1. A lock having a face, a core, an indicator means, a first key and a second key, said core having a keyway adapted for the insertion into said core either of said first key or said second key, said core being rotatable in said lock after insertion of said first key into said keyway, and said core being rotatable in said lock after insertion of said second key into said keyway, said indicator means having an armed position and an indicator position, said indicator means when in said armed position extending at most a short distance from said face of said lock, said indicator means when in said indicator position extending a substantially greater distance from said face of said lock, and in which a rotation of said first key, after insertion of said first key into said keyway, results in a movement of said indicator means from said armed position to said indicator position, and in which, said movement of said indicator means having occurred, a rotation of said second key, after insertion of said second key into said keyway, permits said indicator means to be moved from said indicator position to said armed position, but in which, said movement of said indicator means having occurred, rotation by said first key of said core does not permit said indicator means to be moved from said indicator position to said armed position.

2. A lock as in claim 1 wherein said first key has a grip and second key has a grip, and said grip of said first key is dissimilar geometrically to said grip of said second key.

3. A lock as in claim 1 wherein said first key has a grip and second key has a grip, and wherein said grip of said first key has an identifying aperture and said grip of said second key has an identifying aperture, and said identifying aperture of said first key is dissimilar geometrically to said identifying aperture of said second key.

4. A lock as in claim 1 wherein rotation by a person of said second key, after the insertion of said second key into said keyway and when said indicator means is in said indicator position, transmits to said person a tactile sensation different from the tactile sensation transmitted to said person when said indicator means is in said armed position and said person rotates said second key after insertion of said second key into said keyway.

5. A lock having a face, a core, a first indicator means, a second indicator means, a first key, a second key, and a third key, said core having a keyway adapted for the insertion into said core of either said first key or said second key or said third key, said core being rotatable in said lock after insertion of said first key into said keyway, or after insertion of said second key into said keyway, or after insertion of said third key into said keyway, said first indicator means having an armed position A and an indicator position AA, and said second indicator means having an armed position B and an indicator position BB, said first indicator means when in said armed position A extending at most a short distance from said face of said lock, said first indicator means when in said indicator position AA extending a substantially greater distance from said face of said lock, and said second indicator means when in said armed position B extending at most a short distance from said face of said lock, said second indicator means when in said indicator position BB extending a substantially greater distance from said face of said lock, and in which a rotation of said first key, after insertion of said first key into said keyway, results in a movement of said first indicator means from said armed position A to said indicator position AA, and in which a rotation of said second key, after insertion of said second key into said keyway, results in a movement of said second indicator means from said armed position B to said indicator position BB, and in which, said movement of said first indicator means having occurred, a rotation of said third key, after insertion of said third key into said keyway, permits said first indicator means to be moved from said indicator position AA to said armed position A, and in which, said movement of said second indicator means having occurred, a rotation of said third key, after insertion of said third key into said keyway, permits said second indicator means to be moved from said indicator position BB to said armed position B, but in which, said movement of said first indicator means having occurred, a rotation by either said first key or by said second key of said core does not permit said first indicator means to be moved from said indicator position AA to said armed position A, and in which said movement of said second indicator means having occurred, a rotation by either said first key or by said second key of said core does not permit said second indicator means to be moved from said indicator position BB to said armed position B.

6. A lock as in claim 5 wherein said first key has a grip, second key has a grip, and said third key has a grip, and wherein said grips of said first and second keys are geometrically dissimilar, but in which said grip of said third key is similar geometrically to one of said grips of said first and second keys.

7. A lock as in claim 5 wherein said first key has a grip, second key has a grip, and said third key has a grip, wherein said grip of said first key has an identifying aperture, said grip of said second key has an identifying aperture, and said grip of said third key has an identifying aperture, and wherein no two of said identifying apertures are geometrically similar.

8. A lock as in claim 5 wherein rotation by a person of said third key, after the insertion of said third key into said keyway and when both said first indicator means and said second indicator means are in their respective said armed positions A and B, transmits to said person a first tactile sensation, and wherein rotation by said person of said third key, after the insertion of said third key into said keyway and when only one of said first indicator means and said second indicator means is in said armed position A or said armed position B, transmits to said persona second tactile sensation, and wherein rotation by said person of said third key, after the insertion of said third key into said keyway and when neither said first indicator means nor said second indicator means is in said armed position A or said armed position B, transmits to said person a third tactile sensation, and wherein no two of said first, said second, and said third tactile sensations are the same.

9. A lock as in claim 5 wherein said first indicator means when in said indicator position AA displays a first colored marking, and wherein said second indicator means when in said indicator position BB displays a second colored marking, and in which said first and second colored markings are not the same color.

10. A lock having a core, a trigger means, a reset means, an indicator means, a first key and a second key, said core having a keyway adapted for insertion either of said first key or said second key into said core, said core being rotatable in said lock after the insertion either of said first key or said second key into said keyway, said trigger means but not said reset means being rotatable in said lock after insertion of said first key into said keyway, said reset means but not said trigger means being rotatable in said lock after insertion of said second key into said keyway, said reset means being contained entirely within said lock, said indicator means having an armed position and an indicator position, and in which a rotation of said trigger means results in a movement of said indicator means from said armed position to said indicator position, and further in which a rotation of said reset means permits said indicator means to be moved from said indicator position to said armed position, but in which a rotation of said trigger means does not permit said indicator means to be moved from said indicator position to said armed position.

11. A lock as in claim 10 wherein said lock has tumblers, and in which said trigger means has a substantially annular edge and a bore through which one of said tumblers is free to move, and in which said bore is tangent to said substantially annular edge.

12. A lock as in claim 10 wherein said lock has tumblers, and in which said reset means has a substantially annular edge and a bore through which one of said tumblers is free to move, and in which said bore is tangent to said substantially annular edge.

13. A lock as in claim 10 wherein said indicator means, when in said armed position, communicates with a compressed spring, and said compressed spring urges said indicator means out of said lock.

14. A lock as in claim 10 wherein said lock has a rear sleeve, and wherein said indicator means has a trough, said trough having a front wall and a rear wall, and in which said movement of said indicator means from said armed position to said indicator position is limited by the contact of said rear sleeve with said rear wall.

15. A lock as in claim 10 wherein said lock has a front sleeve, and wherein said indicator means has a trough, said trough having a front wall and a rear wall, and in which said movement of said indicator means from said indicator position to said armed position is limited by the contact of said front sleeve with said front wall.

16. A lock as in claim 14 or claim 15, said lock further having a means for retaining said sleeve in said lock, and in which said sleeve, when in contact with said trough, is not in contact with said means for retaining said sleeve.

17. A lock as in claim 14 or claim 15 wherein said indicator means is held in a cylindrical bore in said lock, and wherein said indicator means has a shape that is substantially cylindrical, said shape having a lengthwise axis, and wherein said trough has two side walls, and said indicator means is prevented from rotating about said lengthwise axis in said cylindrical bore by the obstruction of said side walls by said sleeve.

18. A lock as in claim 14 or claim 15 wherein said indicator means is held in a bore in said lock, and wherein said indicator means has a lengthwise axis, and wherein said sleeve is tubular in shape, said tubular shape having an inside diameter, and in which said sleeve contains an upper pin free to move within said sleeve, and further in which-:said indicator means has a bore orthogonal to said lengthwise axis and a lower pin free to move within said bore, and in which said lock is adapted to allow said upper pin and said lower pin to be brought into communication with each other, and in which said inside diameter of said sleeve is less than the diameter of said bore of said indicator means.

19. A lock as in claim 10 wherein said indicator means is held in a cylindrical bore in said lock and wherein said indicator means has a shape that is substantially cylindrical.

20. A lock as in claim 19 wherein said shape of said indicator means comprises a flat portion and a fully-cylindrical portion adjacent to said flat portion, and wherein said lock has tumblers, and further wherein said trigger means has a shape that is substantially tubular and is adapted to be mounted on said core, said trigger means further having a bore through which one of said tumblers is free to pass, said tumbler rotating always with said trigger means when said trigger means is rotated in said lock, and said tumbler is blocked from rotating in said lock by said fully-cylindrical portion of said indicator means when said indicator means is in said armed position.

21. A lock as in claim 19 in which said shape of said indicator means comprises a flat portion and a fully-cylindrical portion adjacent to said flat portion, and wherein said trigger means has a shape that is substantially tubular and is adapted to be mounted on said core, said trigger means further having a plateau portion extending radially outward from the outer surface of said tubular shape, and said plateau portion is blocked from rotation by said fully-cylindrical portion of said indicator means when said indicator means is in said armed position.

22. A lock as in claim 21 wherein said plateau portion of said trigger means has at least two beveled sides.

23. A lock as in claim 21 wherein said indicator means, when in said indicator position, remains locked in said indicator position until reset, and in which said plateau portion of said trigger means is first freed to rotate past said fully-cylindrical portion of said indicator means only after said indicator means has locked in said indicator position.

24. A lock as in claim 20 wherein said indicator means, when in said indicator position, remains locked in said indicator position until reset, and in which said tumbler is first freed to rotate past said fully-cylindrical portion of said indicator means only after said indicator means has locked in said indicator position.

25. A lock as in claim 19 in which said indicator means has a lengthwise axis and a bore orthogonal to said axis, and in which said indicator means when in said armed position remains locked in said armed position by a pin in said bore and movable in said bore, and in which said trigger means is adapted to lift said pin when said trigger means is rotated by said first key, said pin, when lifted by said trigger means, freeing said indicator means to move from said armed position to said indicator position.

26. A lock as in claim 25 in which said trigger means has a wedge-shaped cutout adapted to communicate with and to lift said pin.

27. A lock as in claim 26 wherein said wedge-shaped cutout has two beveled faces that do not intersect.

28. A lock as in claim 26 wherein said trigger means has an annular edge and a parallel, substantially annular edge, and said wedge-shaped cutout intersects said substantially annular edge.

29. A lock as in claim 28 wherein said wedge-shaped cutout has a face, and in which said face is a plane, said plane being parallel to said substantially annular edge, but said plane being closer to said annular edge.

30. A lock as in claim 19 in which said indicator means has a lengthwise axis and a bore orthogonal to said lengthwise axis, and in which said indicator means when in said indicator position remains locked in said indicator position by a pin in said bore and movable in said bore, and in which said reset means is adapted to lift said pin when said reset means is rotated by said second key, said pin when lifted by said reset means freeing said indicator means to move from said indicator position to said armed position.

31. A lock as in claim 30 wherein said reset means has a shape that is substantially tubular and is adapted to be mounted on said core, said reset means further having at least one plateau portion extending radially outward from the outer surface of said tubular shape, said plateau portion being adapted to lift said pin when said reset means is rotated by said second key.

32. A lock as in claim 31 wherein each plateau portion of said reset means has at least two beveled sides.

33. A lock having a core, a first trigger means, a second trigger means, a reset means, a first indicator means, a second indicator means, a first key, a second key, and a third key, said core having a keyway adapted for insertion either of said first key or said second key or said third key into said core, said core being rotatable in said lock after the insertion either of said first key or said second key or said third key into said keyway, said first trigger means but neither said second trigger means nor said reset means being rotatable in said lock after insertion of said first key into said keyway, said second trigger means but neither said first trigger means nor said reset means being rotatable in said lock after insertion of said second key into said keyway, said reset means but neither said first trigger means nor said second trigger means being rotatable in said lock after insertion of said third key into said keyway, said first indicator means having an armed position A and an indicator position AA, and said second indicator means having an armed position B and an indicator position BB, and in which rotation of said first trigger means results in a movement of said first indicator means from said armed position A to said indicator position AA, and in which rotation of said second trigger means results in a movement of said second indicator means from said armed position B to said indicator position BB, and in which rotation of said reset means permits said first indicator means to be moved from said indicator position AA to said armed position A, and furthermore in which rotation of said reset means permits said second indicator means to be moved from said indicator position BB to said armed position B, but in which rotation neither of said first trigger means nor of said second trigger means permits said first indicator means to be moved from said indicator position AA to said armed position A, and in which rotation neither of said first trigger means nor of said second trigger means permits said second indicator means to be moved from said indicator position BB to said armed position B.

34. A lock as in claim 33 in which said lock has tumblers, and in which said first trigger means has a substantially annular edge and a bore through which one of said tumblers is free to move, said bore of said first trigger means being tangent to said substantially annular edge of said first trigger means, and in which said second trigger means has a substantially annular edge and a bore through which another of said tumblers is free to move, said bore of said second trigger means being tangent to said substantially annular edge of said second trigger means.

35. A lock as in claim 33 in which said lock has tumblers, and in which said reset means has a substantially annular edge and a bore through which one of said tumblers is free to move, and in which said bore is tangent to said substantially annular edge.

36. A lock as in claim 33 wherein said first indicator means, when in said armed position A, communicates with a first compressed spring, and said first compressed spring urges said first indicator means out of said lock, and wherein said second indicator means, when in said armed position B, communicates with a second compressed spring, and said second compressed spring urges said second indicator means out of said lock.

37. A lock as in claim 33 wherein said lock has a first rear sleeve and a second rear sleeve, and wherein said first indicator means has a trough, said trough having a front wall and a rear wall, and in which said movement of said first indicator means from said armed position A to said indicator position AA is limited by the contact of said first rear sleeve with said rear wall of said trough, and wherein said second indicator means has a similar trough, said similar trough having a front wall and a rear wall, and in which said movement of said second indicator means from said armed position B to said indicator position BB is limited by the contact of said second rear sleeve with said rear wall of said similar trough.

38. A lock as in claim 33 wherein said lock has a first front sleeve and a second front sleeve, and wherein said first indicator means has a trough, said trough having a front wall and a rear wall, and in which said movement of said first indicator means from said indicator position AA to said armed position A is limited by the contact of said first front sleeve with said front wall of said trough, and wherein said second indicator means has a similar trough, said similar trough having a front wall and a rear wall, and in which said movement of said second indicator means from said indicator position BB to said armed position B is limited by the contact of said second front sleeve with said front wall of said similar trough.

39. A lock as in claim 37 or claim 38, said lock further having means for retaining said sleeves in said lock, and in which said sleeves, when in contact with said troughs, are not in contact with said means for retaining said sleeves.

40. A lock as in claim 37 or claim 38 wherein said first indicator means is held in a first cylindrical bore in said lock and said second indicator means is held in a second cylindrical bore in said lock, and wherein said first indicator means has a shape that is substantially cylindrical, said shape having lengthwise axis X1, and wherein said trough of said first indicator means has two side walls, and in which said first indicator means is prevented from rotating about said lengthwise axis X1 in said first cylindrical bore by the obstruction of said side walls of said trough by said first sleeve, and wherein said second indicator means also has a shape that is substantially cylindrical, said shape of said second indicator means having lengthwise axis X2, and wherein said similar trough of said second indicator means has two side walls, and in which said second indicator means is prevented from rotating about said lengthwise axis X2 in said second cylindrical bore by the obstruction of said side walls of said similar trough by said second sleeve.

41. A lock as in claim 37 or claim 38 wherein said first indicator means is held in a first bore in said lock and said second indicator means is held in a second bore in said lock, and in which said first indicator means has lengthwise axis X1, and in which said first sleeve is tubular in shape, said tubular shape having an inside diameter, and in which said first sleeve contains a first upper pin free to move within said first sleeve, and further in which said first indicator means has a bore orthogonal to said lengthwise axis X1 and a first lower pin free to move within said bore, said lock being adapted to allow said first upper pin and said first lower pin to be brought into communication with each other, and in which said inside diameter of said first sleeve is less than the diameter of said bore in said first indicator means, and wherein said second indicator means has lengthwise axis X2, and wherein said second sleeve is tubular in shape, said tubular shape having an inside diameter, and in which said second sleeve contains a second upper pin free to move within said second sleeve, and further in which said second indicator means has a similar bore orthogonal to said lengthwise axis X2 and a second lower pin free to move within said similar bore, said lock being adapted to allow said second upper pin and said second lower pin to be brought into communication with each other, and in which said inside diameter of said second sleeve is less than the diameter of said similar bore of said second indicator means.

42. A lock as in claim 33 wherein said first and second indicator means are held in separate, cylindrical bores in said lock and wherein said first indicator means has a shape that is substantially cylindrical, and wherein second indicator means has a shape that is substantially cylindrical.

43. A lock as in claim 33 wherein said first and second indicator means each have colored portions, said indicator means being adapted to prevent said colored portions from rubbing against said lock when either of the said indicator means moves within said lock.

44. A lock as in claim 42 wherein said shape of said first indicator means comprises a flat portion and a fully-cylindrical portion adjacent to said flat portion, and wherein said shape of said second indicator means comprises two, flat, coplanar portions and a fully-cylindrical portion between said two, flat, coplanar portions, and wherein said lock has tumblers, and wherein said first trigger means has a shape that is substantially tubular and is adapted to be mounted on said core, said first trigger means having a bore through which one of said tumblers is free to pass, said one of said tumblers rotating always with said first trigger means when said first trigger means is rotated in said lock, and wherein said second trigger means has a shape that is substantially tubular and is adapted to be mounted on said core, said second trigger means having a bore through which another of said tumblers is free to pass, said another of said tumblers rotating always with said second trigger means when said second trigger means is rotated in said lock, and in which said one of said tumblers is blocked from rotating in said lock by said fully-cylindrical portion of said first indicator means when said first indicator means is in said armed position A, and in which said another of said tumblers is blocked from rotating in said lock by said fully-cylindrical portion of said second indicator means when said second indicator means is in said armed position B.

45. A lock as in claim 42 wherein said shape of said first indicator means comprises a flat portion and a fully-cylindrical portion adjacent to said flat portion, and wherein said shape of said second indicator means comprises two, flat, coplanar portions and a fully-cylindrical portion between said two, flat, coplanar portions, and wherein said first trigger means has shape T1 that is substantially tubular and is adapted to be mounted on said core, said first trigger means further having a plateau portion extending radially outward from the outer surface of said tubular shape T1, and wherein said second trigger means has shape T2 that is substantially tubular and is adapted to be mounted on said core, said second trigger means further having a plateau portion extending radially outward from the outer surface of said tubular shape T2, said plateau portion of said first trigger means being blocked from rotation in said lock by said-fully cylindrical portion of said first indicator means when said first indicator means is in said armed position A, and said plateau portion of said second trigger means being blocked from rotation in said lock by said fully-cylindrical portion of said second indicator means when said second indicator means is in said armed position B.

46. A lock as in claim 45 in which said plateau portion of said first trigger means has at least two beveled flat sides, and in which said plateau portion of said second trigger means has at least two beveled flat sides.

47. A lock as in claim 44 or 45 in which said shapes of said first and second trigger means are congruent.

48. A lock as in claim 45 wherein said first indicator means, when in said indicator position AA, remains locked in said indicator position AA until reset, and in which said plateau portion of said first trigger means is first freed to rotate past said fully-cylindrical portion of said first indicator means only after said first indicator means has locked in said indicator position AA, and wherein said second indicator means, when in said indicator position BB, remains locked in said indicator position BB until reset, and in which said plateau portion of said second trigger means is first freed to rotate past said fully-cylindrical portion of said second indicator means only after said second indicator means has locked in said indicator position BB.

49. A lock as in claim 44 wherein said first indicator means, when in said indicator position AA, remains locked in said indicator position AA until reset, and in which said one of said tumblers is first freed to rotate past said fully-cylindrical portion of said first indicator means only after said first indicator means has locked in said indicator position AA, and in which said second indicator means, when in said indicator position BB, remains locked in said indicator position BB until reset, and in which said another of said tumblers is first freed to rotate past said fully-cylindrical portion of said second indicator means only after said second indicator means has locked in said indicator position BB.

50. A lock as in claim 42 wherein said first indicator means has a lengthwise axis and a bore orthogonal thereto, and in which said first indicator means, when in said armed position A, remains locked in said armed position A by a pin in said bore and movable in said bore, said first trigger means being adapted to lift said pin in said bore of said first indicator means when said first trigger means is rotated by said first key, said pin when lifted by said first trigger means freeing said first indicator means to move from said armed position A to said indicator position AA, and wherein said second indicator means has a lengthwise axis and a similar bore orthogonal thereto, and in which said second indicator means when in said armed position B remains locked in said armed position B by a pin in said similar bore and movable in said similar bore, and in which said second trigger means is adapted to lift said pin in said similar bore of said second indicator means when said second trigger means is rotated by said second key, said pin when lifted by said second trigger means freeing said second indicator means to move from said armed position B to its said indicator position BB.

51. A lock as in claim 50 wherein said first trigger means has a wedge-shaped cutout adapted to communicate with and to lift said pin in said bore of said first indicator means, and in which said second trigger means has a wedge-shaped cutout adapted to communicate with and to lift said pin in said bore of said second indicator means.

52. A lock as in claim 51 wherein each said wedge-shaped cutout has two beveled faces that do not intersect.

53. A lock as in claim 51 wherein each said trigger means has a substantially annular edge and a parallel, annular edge, and in which the said wedge-shaped cutout of each said trigger means intersects that said trigger mean's said substantially annular edge.

54. A lock as in claim 53 wherein each said wedge-shaped cutout has a face, said face being a plane and said plane being parallel to the substantially annular edge of the said trigger means in which the said wedge-shaped cutout is located, said plane being closer, however, to the annular edge of the said trigger means in which the said wedge-shaped cutout is located.

55. A lock as in claim 42 wherein said first indicator means has a lengthwise axis and a bore orthogonal to said lengthwise axis, and in which said first indicator means when in said indicator position AA remains locked in its said indicator position AA by a pin in said bore and movable in said bore, and in which said reset means is adapted to lift said pin when said reset means is rotated by said third key, said pin when lifted by said reset means freeing said first indicator means to move from said indicator position AA to said armed position A, and wherein said second indicator means also has a lengthwise axis and a similar bore orthogonal thereto, and in which said second indicator means when in said indicator position BB remains locked in said indicator position BB by a pin in said similar bore and movable in said similar bore, and in which said reset means is adapted to lift said pin in said similar bore of said second indicator means when said reset means is rotated by said third key, said pin in said similar bore of said second indicator means when lifted by said reset means freeing said second indicator means to move from said indicator position BB to said armed position B.

56. A lock as in claim 55 wherein said reset means has a shape that is substantially tubular and is adapted to be mounted on said core, said reset means further having at least one plateau portion extending radially outward from the outer surface of said tubular shape, said plateau portion being adapted to lift either of said pins when said reset means is rotated by said third key.

57. A lock as in claim 56 wherein each plateau portion of said reset means has at least two beveled flat sides.

58. A lock comprising a core, a set of tumblers, a first key, a second key, a first indicator means having unobtrusive state A and indicator state AA, a second indicator means having unobtrusive state B and indicator state BB, said first key being rotatable in said lock, said rotation of said first key in said lock being sufficient to change the state of said first indicator means from said unobtrusive state A to said indicator state AA, said second key being rotatable in said lock, said rotation of said second key in said lock being sufficient to change the state of said second indicator means from said unobtrusive state B to said indicator state BB, said first key being rotatable in said lock whether or not said second key has been rotated in said lock, said second key being rotatable in said lock whether or not said first key has been rotated in said lock, said core having a lengthwise axis and a keyway into which said first and second keys may be inserted, said core having a number of bores, each bore having a reference point that locates said bore with respect to said core, all said reference points lying in a single plane parallel to said lengthwise axis of said core, said bores being adapted to hold said tumblers, said tumblers communicating with said first key when said first key is inserted into said keyway and said tumblers are in said bores, said tumblers further communicating with said second key when said second key is inserted into said keyway and said tumblers are in said bores, said number of bores being equal to the number of said tumblers, and said bores being located in said core such that the distance between the reference points of adjacent bores is not the same for all pairs of adjacent bores.

59. A lock as in claim 58 wherein said key has a set of keycuts, each keycut having a shape adapted to communicate with at least one of said tumblers, and in which the number of said keycuts is greater than the number of said tumblers.

60. A lock as in claim 58 wherein each keycut has a depth and in which at least one of said keycuts has a depth that may be altered without affecting the ability of said core to rotate in said lock when said key is inserted into said keyway.

* * * * *